US005947423A

United States Patent [19]

Clifton et al.

[11] Patent Number: 5,947,423

[45] Date of Patent: Sep. 7, 1999

[54] VEHICLE CONTROL SYSTEM

[75] Inventors: Ray Clifton, Malmesbury; Steve Sadler, Leeds; Ewan Dunlop, Devizes, all of United Kingdom

[73] Assignee: Westinghouse Brake and Signal Holdings Limited, Wiltshire, United Kingdom

[21] Appl. No.: 08/945,215

[22] PCT Filed: Apr. 24, 1996

[86] PCT No.: PCT/GB96/00977

§ 371 Date: Dec. 22, 1997

§ 102(e) Date: Dec. 22, 1997

[87] PCT Pub. No.: WO96/33899

PCT Pub. Date: Oct. 31, 1996

[30] Foreign Application Priority Data

Apr. 28, 1995 [GB] United Kingdom ..... 9508681

[51] Int. Cl.[6] ..... B61L 21/00

[52] U.S. Cl. ..... 246/62; 246/63 R; 246/167 R; 246/177

[58] Field of Search ..... 246/8, 14, 62, 246/63 R, 122 R, 132, 167 R, 177

[56] References Cited

U.S. PATENT DOCUMENTS

| | | | |
|---|---|---|---|
| Re. 28,867 | 6/1976 | Baba et al. | 246/9 |
| 3,774,025 | 11/1973 | Auer, Jr. et al. | 246/122 R |
| 3,888,437 | 6/1975 | Birkin | 246/63 R |
| 4,007,897 | 2/1977 | Auer, Jr. | 246/63 R |
| 5,129,605 | 7/1992 | Burns et al. | 246/122 R |
| 5,590,855 | 1/1997 | Kato et al. | 246/122 R |

*Primary Examiner*—Mark T. Le
*Assistant Examiner*—Robert J. McCarry, Jr.
*Attorney, Agent, or Firm*—Welsh & Katz, Ltd.

[57] ABSTRACT

A vehicle control system issues control signals to vehicles to control their movements along a route between a first location and a second location, the vehicles comprising a set of vehicles of a first type, to which the system can issue control signals at more than one location within the route, and a set of vehicles of a second type to which the system cannot issue control signals at more than one location within the route. Sending devices sense vehicles entering and leaving the route and the type of these vehicles, storage devices stores a record of the number of vehicles within the route and a record of the type of vehicle that most recently entered the route, signalling devices signal to vehicles whether they may enter the route by moving beyond the first location and control devices receives information from the storage devices and transmits signals to the signalling devices. In response to the storage devices indicating that there is at least one vehicle within the route and that the vehicle that most recently entered the route was of the first type, the control devices controls the signalling devices to issue a signal of a first type indicating that only vehicles of the first type may enter the route. In response to the storage devices indicating that there are no vehicles within the route, the control devices controls the signalling devices to issue a signal of a second type indicating that vehicles of the first type or the second type may enter the route. Otherwise the control devices controls the signalling devices to issue a signal of a third type indicating that no vehicles may enter the route.

5 Claims, 16 Drawing Sheets

(i.e. SEG 11 OFFSET 100, NEGATIVE, 2 NODES, (REVERSE, REVERSE))

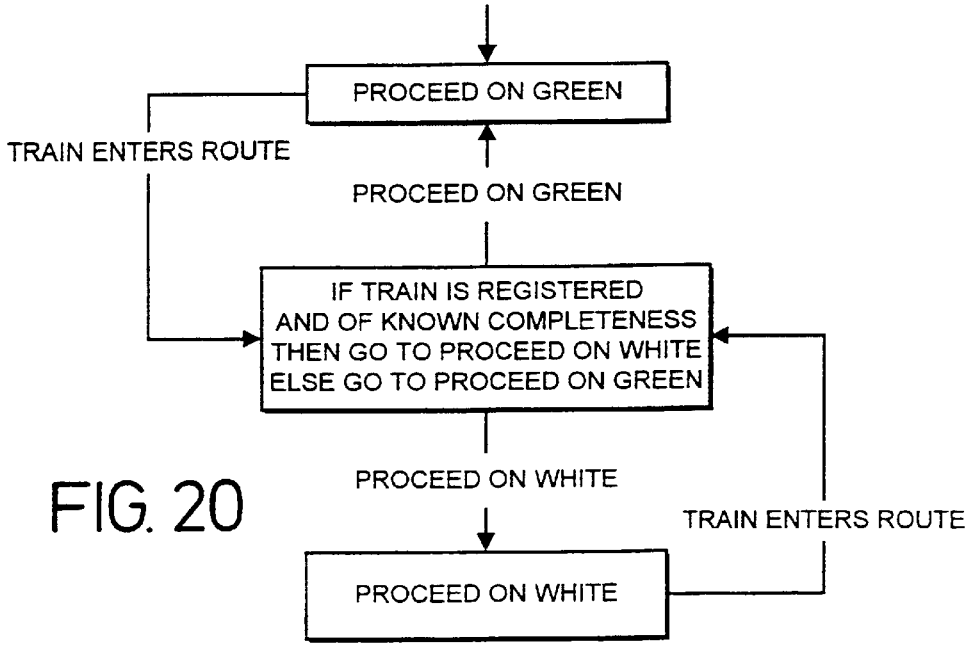
FIG. 20
FIG. 21
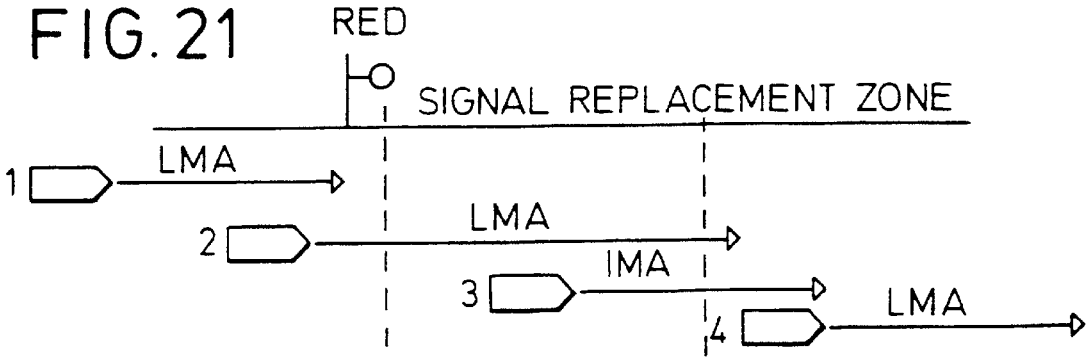
FIG. 22
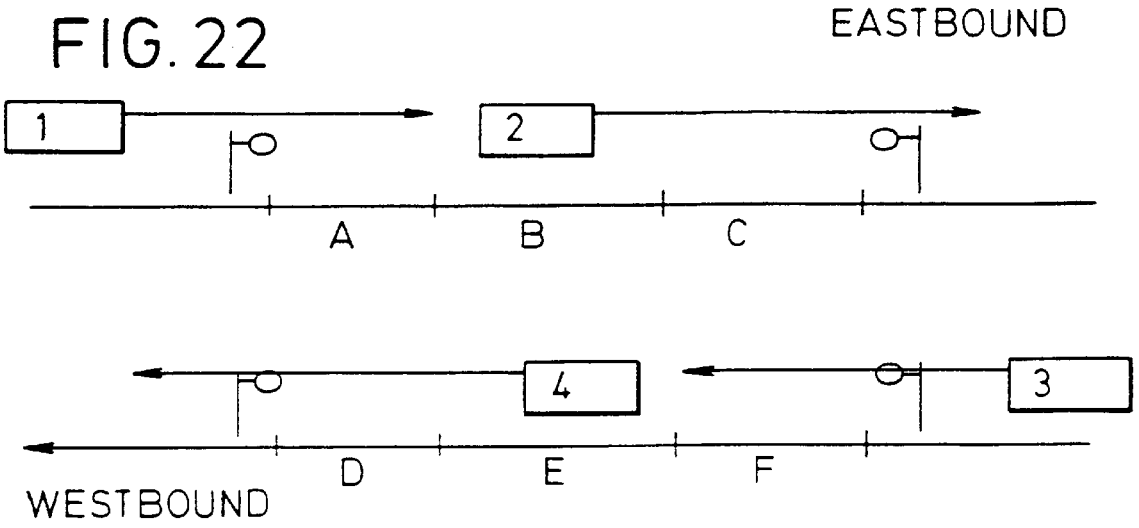

VEHICLE CONTROL SYSTEM

The present invention relates to a vehicle control system, for example for use in signalling vehicles moving within a transport system such as a railway.

According to a first aspect of the present invention there is provided a vehicle control system for issuing control signals to vehicles to control their movements along a route between a first location and a second location, the vehicles comprising a set of vehicles of a first type, to which the system can issue control signals at more than one location within the route and a set of vehicles of a second type to which the system cannot issue control signals at more than one location within the route, the system comprising: sensing means for sensing vehicles entering and leaving the route, and the type of those vehicles; storage means for storing a record of the number of vehicles within the route and a record of the type of vehicle that most recently entered the route; signalling means for signalling to vehicles whether they may enter the route by moving beyond the first location; and control means for receiving information from the storage means and transmitting signals to the signalling means, and: 1) in response to the storage means indicating that there is at least one vehicle within the route and that the vehicle that most recently entered the route was of the first type controlling the signalling means to issue a signal of a first type, indicating that only vehicles of the first type may enter the route; 2) in response to the storage means indicating that there are no vehicles within the route controlling the signalling means to issue a signal of a second type, indicating that vehicles of the first type or the second type may enter the route; 3) otherwise controlling the signalling means to issue a signal of a third type, indicating that no vehicles may enter the route.

According to a second aspect of the present invention there is provided a vehicle control system for issuing signals to vehicles to control their movements along a route between a first location and a second location, to allow the direction of travel of vehicles along that route to be reversed from a first direction towards the second location to a second direction towards the first location, the system comprising: signalling means for signalling to vehicles to indicate the movements the vehicles are permitted to make; sensing means for sensing the presence and/or location of vehicles; processing means for processing information received from the sensing means to determine the safety of movement of vehicles; and control means for controlling the signalling means and, in response to a command to reverse the direction of travel of vehicles along the route from the first direction to the second direction: 1) controlling the signalling means to signal any vehicles within the route to halt; 2) controlling the signalling means to signal any vehicles approaching the route not to enter the route in the first direction by passing beyond the second location or in the second direction by passing beyond the first location; 3) waiting for a period sufficient to allow any vehicles within the route to reach a halt; and 4) if the processing means determines it is safe, controlling the signalling means to signal any vehicles within the route to move in the second direction and/or controlling the signalling means to permit a vehicle to enter the route in the second direction.

According to a third aspect of the present invention there is provided a vehicle control system for controlling the movement of vehicles comprising: a processing unit for receiving information from the vehicles to determine their status and transmitting information to the vehicles to control their movements; and communication means comprising at least one leaky feeder antenna positioned along the anticipated route of the vehicles and a receiving antenna on each vehicle for receiving signals from the leaky feeder antenna for allowing substantially continuous bidirectional communications between the vehicles and the processing unit by means of a leaky feeder radio system.

According to a fourth aspect of the present invention there is provided a vehicle door control system for controlling a vehicle's doors at a stopping location, the system comprising: communication means comprising a receiver located on the vehicle and a transponder located at the stopping location, the communication means being such that the receiver can only communicate with the transponder when the vehicle is at a predetermined stopping position; sensing means for sensing that the vehicle is stopped; and door control means for receiving information from the communication means and the sensing means and permitting the vehicle's doors to open when the vehicle is sensed to be stopped and there is communication between the receiver and the transponder. Preferably the stopping position is determined such that with the vehicle in the stopping position the positions of the vehicle's doors correspond to the positions of doors at the stopping location.

According to a fifth aspect of the present invention there is provided a vehicle control system for controlling the movement of a wheeled vehicle, the system comprising: a tachometer for detecting the rate of rotation of the vehicle's wheels; doppler speed measuring apparatus for detecting the vehicle's speed; communication means comprising a receiver borne by the vehicle for periodically communicating with transponders at fixed locations; and processing means for correlating information from the tachometer, the doppler speed measuring apparatus and the communication means to estimate the vehicle's speed and location.

According to a sixth aspect of the present invention there is provided a vehicle control system for issuing signals to control the movements of vehicles within a transport system, comprising: a plurality of sensors for sensing status data concerning the status of the transport system; and a plurality of processing units, each allocated to a respective region of the transport system, for processing the status data to determine the permissible movement of the vehicles and issuing signals to control the vehicles currently located in the units' own regions, each processing unit being linked to the sensors located in its own region for receiving status data from those sensors and linked to at least one processing unit in an adjacent region for receiving status information from outside its own region. Preferably the system also comprises a plurality of communications units, each allocated to a respective zone of the transport system, for communicating with vehicles currently located in the units' own zones, each linked to a single one of the processing units; and each processing unit including routing means for controlling communications from that processing unit to any vehicle in its region by determining the location of the vehicle, determining the zone in which the vehicle is located, determining the processing unit to which the communications unit allocated to that zone is linked, and if the determined processing unit is linked to another processing unit routing communications with the vehicle via that other processing unit.

The present invention will now be described by way of example with reference to the accompanying drawings, in which:

FIG. 20 illustrates the change of status of a route defined according to a preferred aspect of the present system;

FIGS. 21 to 31 illustrate regions of railway track subject to signalling according to a preferred aspect of the present system;

Figure 1:
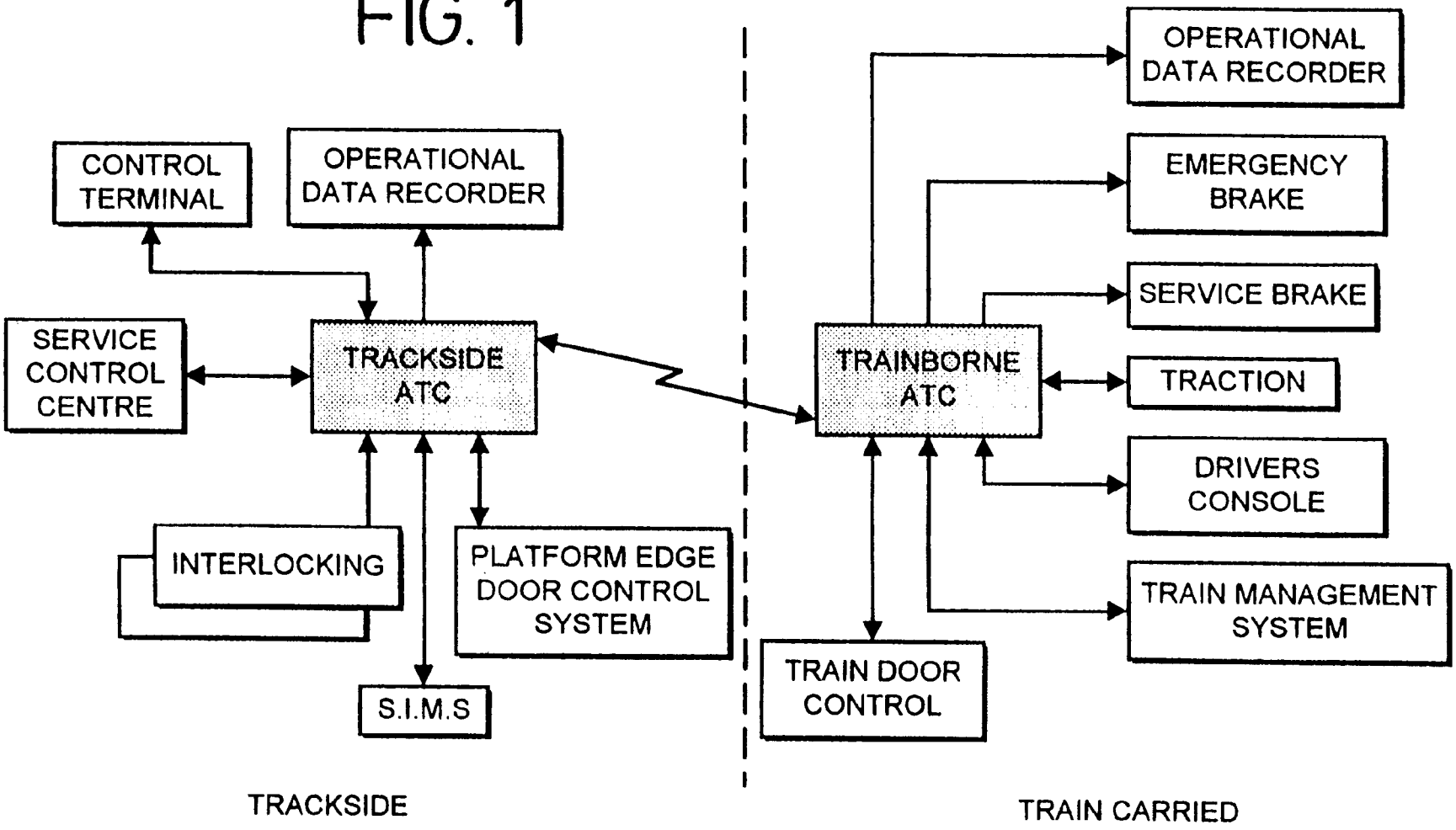
FIG. 1 is a diagram illustrating the present system generally.

The present system is a control and protection system for trains. In conjunction with interlockings and other equipment, the present system provides protection for trains in manual and automatic driving modes. Automatic operation of trains is provided by an Automatic Train Operation (ATO) system. This drives the train within the protection limits set by an Automatic Train Protection (ATP) system to strategies specified by a Service Control Centre (SCC). Both the ATP and the ATO include trackside and train-carried elements.

The present system's interaction with the interlocking is at the aspect level and hence the system can be overlaid onto the existing signalling system. This means that the interlocking can provide signalling for trains which are not equipped with the present system.

The ATP performs all of the safety-critical functions of the present system. Its main function is to apply safety constraints to train movements and door operation, and hence protect against unsafe conditions. The ATP operates by observing the state of the signalling system, determining when a route is available for a train and allowing the train into the route as far as the first obstruction (e.g. back of next train, end of route, other obstruction). This point is known as the Limit of Movement Authority (LMA) for the train.

A Moving-Block Processor (MBP) is the main trackside ATP component; there is generally one MBP for each station and they are interconnected in order to provide complete coverage along the line. The main task of the MBP is to generate LMAs for ATP-equipped trains in order to achieve safe train separation and movement on the line.

The MBP monitors the interlocking in order to determine track circuit status and when routes are set. It continually generates the LMA for each ATP-equipped train in its area of control, using moving-block principles and information provided by the Service Control Centre (SCC). The advantage of moving block over fixed block is that where the LMA for a train is limited by a train ahead, it can move along smoothly behind that train, instead of stepping along in block sections.

The MBP deduces the presence of any trains in its area of control which are not equipped with ATP by monitoring the status of track circuits. An ATP-equipped train immediately behind a non-equipped train is limited to operating on a fixed-block basis, with its LMA stepping along in block sections.

Track circuit failures are handled by the imposition of operating procedures. The MBP continues to provide protection for ATP-equipped trains and allows them to pass through the affected area with minimal disruption to operating service.

LMAs are transmitted to the trains via a series of communication base stations known as Fixed Communication Units (FCU). These receive the LMAs from the MBPs and transmit them to the trains over a high-integrity bi-directional data link (for example by radio, using a leaky feeder principle) which is suitable for the transmission of safety-critical information. The ATP Controller on each train responds by communicating the current position of the train to the MBP.

The LMAs (and speed limits) are enforced by the train-carried ATP using brake assurance. The speed and location of the train are monitored by the ATP Controller (using tachogenerators, doppler speed measuring units and distance recalibration information from trackside transponders) and the emergency brake is requested if the calculated emergency braking profile approaches the LMA (or speed limit). This ensures that the train can never exceed the LMA (or speed limit).

The ATP Controller takes the whole train length into account when monitoring speed limits. Therefore it requests the emergency brakes should the train re-accelerate before its rear is fully clear of a speed limit.

The function of Automatic Train Operation (ATO) is to drive a train automatically between locations as quickly and as smoothly as possible—subject to the constraints imposed by the coasting strategy and the ATP—and to ensure that the train stops accurately at the destination. The ATO system can operate from a given start location along all possible defined routes without prior knowledge of the destination.

The main component of the trackside ATO is the Platform ATO Communicator (PAC). There is generally one PAC per station, each PAC being able to simultaneously communicate with up to 4 stationary trains berthed at ATO Communication Positions (ACPs). The PAC's main function is to serve as a communications controller between the SCC and the train, the Station Information Management System (SIMS) and the train and between the train and the Platform Edge Door (PED) control unit (at stations equipped with PEDs).

The train-carried ATO comprises an ATO Controller (the main processing unit), two receive and two transmit antennas (for communicating with the trackside loops) and a tachogenerator for use in deriving train speed and location.

The train-carried ATO controls the train motors and service brakes to drive between locations on the railway. This is known as autodriving. The train-carried ATO ensures that autodriving is carried out within the constraints imposed by speed limits and by the ATP system. It receives driving strategy information from the SCC (via the PAC) and modifies the way it drives the train accordingly.

Door control is shared between the ATP and ATO systems, the ATP providing the safety critical functions.

The ATP Controller selects the side for which the doors are to be opened and providing that the train is stationary and correctly positioned, enables the correct side doors.

The ATP Controller prevents the train from leaving the station until the PEDs (if fitted) are proved to be closed, or until a PED override switch is operated by the train driver. If the 'PED-closed' detection is lost when no train is at the platform, the speed of any approaching train is restricted to 17 kph as it enters the platform. If the train is already cleared into the station, the train's emergency brakes are requested by the ATP Controller.

At station locations, the train doors are enabled by the ATO if an accurate stop is achieved. At stations equipped with Platform Edge Doors (PEDs), the opening and closing of both the train doors and the PEDs is synchronised by the ATO and Platform ATO Communicator (PAC).

Figure 2:
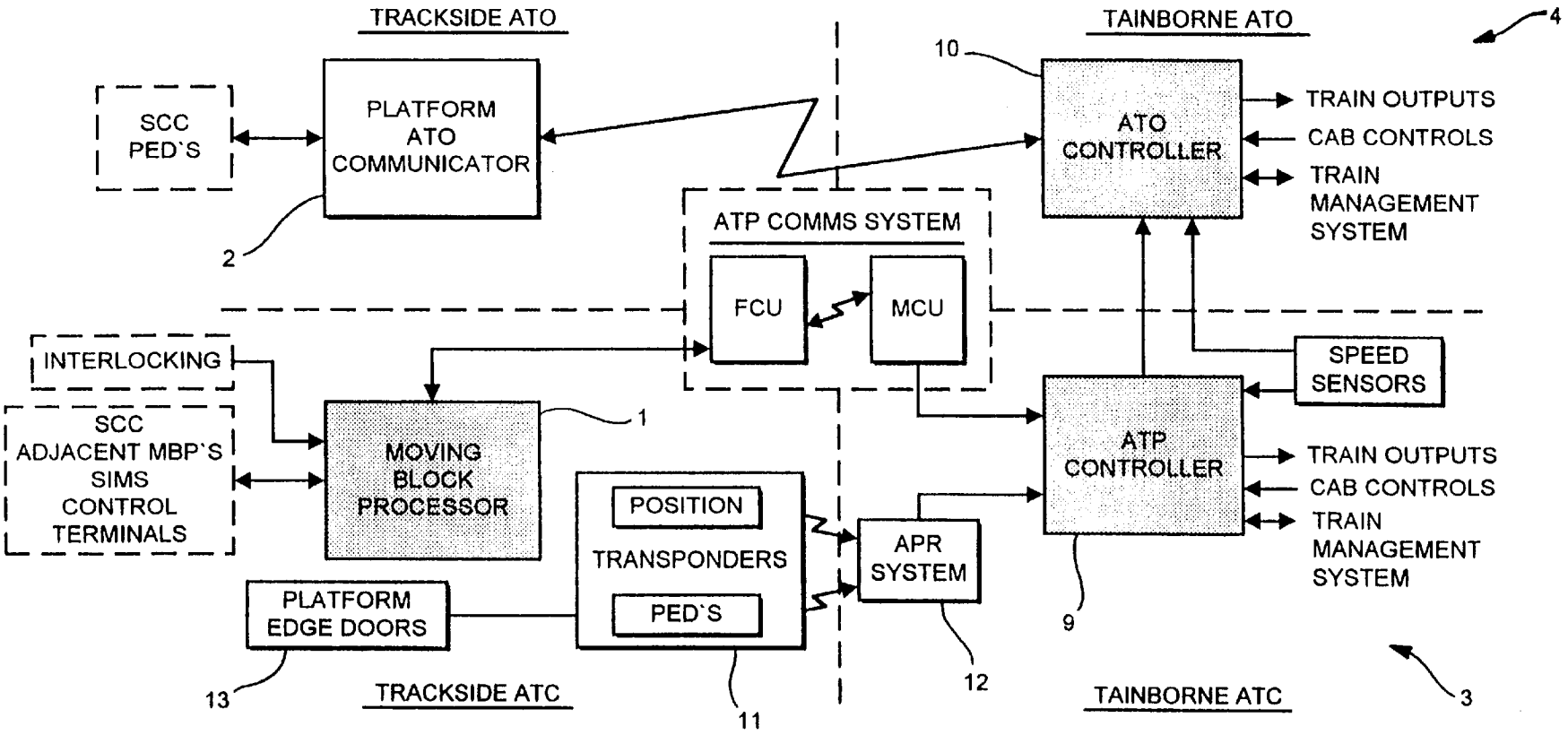
FIG. 2 is an overview of the present system's architecture.

The present system has two distinct parts; the trackside ATC system and the train-carried ATC system. FIG. 1 shows these two systems in their environment and FIG. 2 presents an overview of the present system's architecture.

In general each station area has one or more MBP 1 and one or more PACs 2 (generally one of each). Each train has one set of ATP equipment 3 and one set of ATO equipment 4 at each driving cab. There is no inter-cab communication for either ATP or ATO.

Certain messages and outputs within the ATP system have the inherent potential to grant a permission to the receiving system that in turn enables an unsafe condition to arise. For example, the LMA message from the MBP to the ATP Controller has the potential to grant an LMA beyond the point where it should actually be; the emergency brake output of the ATP Controller has the potential to permit the train to hold off the emergency brakes when they should in fact be on. Such messages and outputs are identified as safety critical.

Within the ATP system, the safety philosophy dictates that at least two lanes of processing are involved in the generation of messages and outputs of a safety critical nature.

Serial messages between protection systems may be routed through a communication link only if at least two processing lanes in the sending system are involved in the generation of the message and are in agreement regarding the message content. The present system is designed so that the availability of the communications links is not essential for system integrity. The integrity of the communication links may be lower than that of the protection systems, provided sufficient checks are made to show whether the message contents are correctly received and come from the stated source.

Discrete outputs of a safety critical nature must be individually derived from at least two processing lanes in order to "grant a permission". An example is the ATP Controller "emergency brake" output. For the train to hold the emergency brakes off, it must receive permission to do so from at least two processing lanes.

In order to achieve a suitably high Mean Time Between Service Failures (MTBSF), processing lanes additional to the two specified above are provided. The ATP Controller and MBP thus each have three processing lanes and are configured in a "2 out of 3" architecture. Where necessary for reliability and availability purposes, multiple communication links are provided and train-carried speed and distance equipment is duplicated.

All messages are generated in two parts for the purpose of message integrity. Each part has the same overall format but the data is in a different form (either true or complement) in each. A lane identity is included in each part of the message. The receiving unit checks that it has data from at least two lanes and that the data matches. The selection and combination of the data to be sent from multiple lanes of processing is thus not a safety-critical function, since any message error caused by this operation will be detected by the unit receiving the data.

Addressing and routing information is added to both parts of the message to allow the message to be routed and to let the receiving unit detect any incorrectly-routed messages. A message sequence number is added to each part of the message to prevent any of the elements between the safety-critical multiple lanes in any two units (e.g. MBP communications modules, modems, radio systems) from repeating or losing messages.

A Cyclic Redundancy Check (CRC) covering all the components of the message is added to each part of the message.

The use of two parts of the message with differing lane identifiers in each allows the receiver of the message to be sure that at least two processing lanes in the source agreed on the message.

In order to achieve a mutual understanding of spatial information between the various system components, there is a need to define a standard convention for identifying locations on the railway.

The railway network is considered to be a series of nodes connected by segments. Nodes will always exist at divergences or convergences in the railway, they may also be placed at other positions in line with implementation constraints.

Each segment is uniquely identified by a segment number.

Any location on the network can be uniquely defined (within the resolution of the system) by a segment number and a number of metres offset into the segment.

The MBP is configured with detection section location in terms of segments and offsets. In order to simplify understanding it has been decided that a simple mapping between detection sections and segments is desirable: that is, as far as possible, detection section boundaries and segment boundaries will coincide. This means that the detection section associated with a set of points will have three segments within it.

The LMA of a train is the path defined by its current route, starting from the trailing edge of the train and terminated by the most restrictive of any obstructions in the route set for the train.

The primary function of the MBP is to generate a safe Limit of Movement Authority (LMA) for each train under its control. An LMA has two components: an absolute position on the railway network beyond which the front of the train must not move and a unique route that the front of the train must follow in order to safely reach the specified location.

Figure 3:
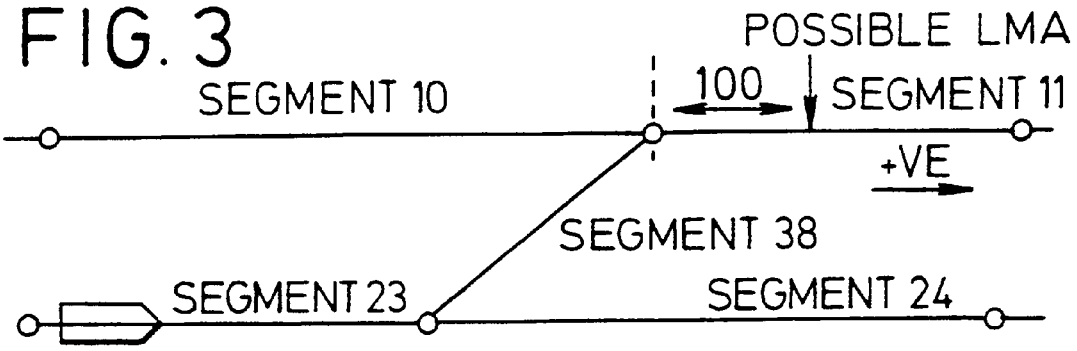
FIG. 3 illustrates a limit of movement authority.

The LMA is represented as the limiting location (given as segment and offset), a direction through the segment that you would travel to get from the location to the train, the number of nodes, and a node list (specifying the direction to take at each node, normal or reverse). This is illustrated in FIG. 3, which illustrates an LMA of "seg 11 offset 100, negative, 2 nodes, (reverse, reverse)".

The present system is designed to allow interworking of registered trains (i.e. trains under the control of the MBP) with trains which are unregistered or unequipped. It is assumed that these trains are themselves protected by railway operating procedures, the interlocking and line-side signals. Registered trains are normally protected from collision with unregistered/unequipped trains by the MBP not allowing the LMA of the registered train within one clear detection section of the unregistered/unequipped trains. At the instant that a registered train becomes un-registered it may not be separated from the preceding train by a clear detection section. This situation is addressed by the use of u-marks as described below.

An N-Train Section (NTS) is an off-line configured, permanent area of the rail network into which only a maximum of N registered trains should be allowed at any one time. They have a number of potential applications including: protecting a protected reversing area at a station or to limit the number of trains in a tunnel.

Note that an NTS has a single entry point and is unidirectional.

A Train Clearance Section (TCS) is an off-line configured, permanent area of the rail network which a train should not be allowed to enter unless it has authority to completely traverse and leave. They have a number of potential applications, including preventing trains stopping over traction gaps or under floodgates.

Note that if a TCS is defined overlapping with an active ESA, the (activated) ESA takes precedence. This means that trains will sometimes stop within TCSs.

An Emergency Stop Area (ESA) is an off-line configured area of the rail network with an associated activation status within the MBP. When activated by an external system any trains within the defined area are required to stop. An application of ESAs would be to handle platform emergency stop areas.

If an ESA overlaps a TCS area, the ESA takes precedence.

There are two types of track speed restriction; permanent and temporary. These restrictions are unidirectional, apply to the whole length of the train and cover a specified area.

The permanent speed restrictions (PSRs) are configuration items and are held by the train-carried ATP and ATO systems in their map data. Every location on the network is subject to exactly one PSR.

A Temporary Speed Restriction (TSR) imposes a speed restriction over a section of track in addition to the permanent speed restriction already associated with that section. The section may have been pre-configured or be imposed at run time by an external control system.

The train is always subject to a PSR and may also be subject to several temporary speed restrictions (TSRs) at any time. If there is more than one speed limit at any location, then the ATP and ATO both act on the lowest of them.

When the train is operating in an appropriate mode, the ATP Controller provides protection by ensuring that the train is at or below the required speed by the required location and that it will remain so throughout the length of the restriction. The ATP Controller takes into account map data such as gradients and the emergency brake characteristics to ensure the train does not infringe the speed limits.

When the ATO system is controlling the train, it calculates service braking profiles for the PSR and any TSRs from its map data in order to obey these restrictions and to ensure that the ATP Controller does not apply the emergency brake unnecessarily.

The State of the Railway (SOR) consists of the state of dynamic railway components which an MBP is interested in for the purpose of generating LMAs (e.g. signals, points, TSRs, train marks). An MBP needs such information for all components within its AOI. Some of an MBP's SOR information is directly supplied to it (e.g. by an interlocking or control centre) but other information is supplied by other (usually adjacent) MBPS.

An MBP's Area Of Control (AOC) is the portion of the network within which it can generate an LMA for a registered train, provided that train is entirely within the AOC.

Figure 4:
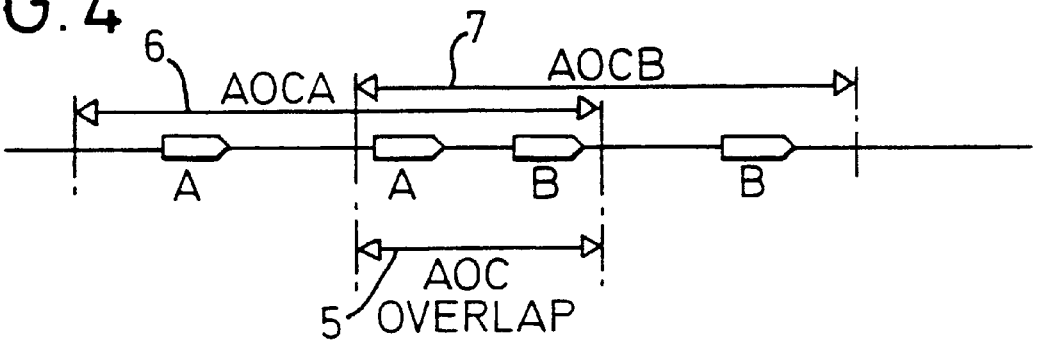
FIG. 4 illustrates a moving block processor's area of control.

Because an MBP cannot propagate an LMA beyond the edge of its own AOC, it is necessary for the AOC of adjacent MBPs to overlap. A train is handed over between MBPs whilst the area allocated to that train is entirely within the AOC overlap. Within an overlap area there may therefore be some trains that are under the control of one MBP and some under the control of the adjacent MBP, as illustrated in FIG. 4.

The size of overlap 5 required for a particular pair of MBPs' AOCs 6,7 is dependent on a number of factors, as follows:

Overlap Distance=(time taken for MBP to recognise that a train is in * max. speed in overlap)+(max. train length)+(worst case stopping distance at max. speed in overlap)+(handover time * max. speed in overlap).

The overlapping of AOCs provides a smooth mechanism for the handover of control from one MBP to the next, ensuring that the task of generating an LMA for any one train is never shared between MBPs.

An MBP has to know the State of the Railway (SOR), including train locations, for a certain distance beyond the AOC boundary in order to safely generate LMAs up to that boundary. For example, an unregistered train might be occupying the detection section adjacent to the MBP's AOC; the MBP needs to know the state of that detection section in order to keep the LMAs of approaching trains one detection section clear from it.

Figure 5:
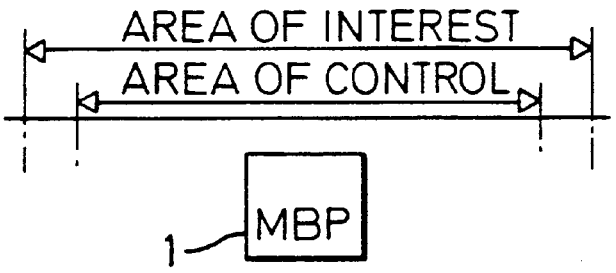
FIG. 5 illustrates a moving block processor's area of interest.

The overlap beyond the edge of the AOC in which an MBP needs to know the SOR defines its Area Of Interest (AOI)—see FIG. 5.

In order to properly control the issuing of LMAs to trains the MBP requires knowledge of the state of signals, points and detection sections. This information is provided by one or more interlockings.

Interlocking information is provided to the MBP either directly over one of its interlocking interfaces or indirectly via other MBPS.

The MBP interlocking area is defined as the area of railway defined by the set of track components (points, signals and detection sections) which are available to that MBP directly from its interlocking interfaces.

Note that configurable features such as ESA and TSR must be configured to reside wholly within a single MBP Interlocking Area. Thus, for example, if there is a requirement for a TSR to span an MBP Interlocking Area boundary, it is necessary to set up two abutting TSRs, one either side of the boundary, each residing within a separate MBP Interlocking Area.

An MBP may communicate with a train either directly via a connected Fixed Communications Unit (FCU) (8 in FIG. 2), or indirectly via an FCU attached to another MBP. The MBP communication area is defined as that area of the railway which can be covered by the FCUs attached to the MBP directly.

Each MBP communication area is divided up into one or more communication zones. A communication zone is an area of the railway covered by a single Fixed Communication Unit (FCU). When an MBP wishes to communicate with a train it locates the train in terms of the most likely communications zone or zones and then transmits via the FCU for that zone. In some cases the comms zone will be associated with another MBPs communication area.

There are two ATP Controllers (i.e. one in each of the train cabs) working in isolation from each other. At most one ATP Controller on each train is active at any one time; the other Controller is inactive. The active state is dependant upon an input from the train circuits which indicates that that cab is in control of train movement (note that the train circuits are interlocked such that only one cab can be in control at any one time.)

An inactive Controller plays no part in train protection, but continues to monitor the location of the train via the speed sensors and APR system.

A train driver selects his train's operating mode and this is supplied to the ATP and ATO Controllers (9 and 10 respectively in FIG. 2). The train modes which the equipment of the present system recognises and responds to are:

Auto Mode (also known as "Manned Automatic")

The ATP system provides full protection for the train in conjunction with the MBP network. The ATO system drives the train automatically between stations. Note that the ATO system is used to drive the train only in Auto mode, although other ATO functions such as door control and TMS communication are available in the other modes.

Coded Manual Mode (also known as "Protected Manual")

The ATP Controller provides full protection for the train in conjunction with the MBP network. The train driver is permitted to drive the train manually up to a predetermined speed close to the prevailing PSR or TSR, using cab display information supplied by the ATP Controller.

Restricted Manual Mode

This mode is used for forward movement in depots, on track where no ATP communications link exists, or in emergencies (e.g. the failure of trackside equipment which provides speed and LMA information). The ATP Controller provides limited protection for the train by restricting its speed to no more than a configurable speed, for example 17 km/h Reverse Mode This mode is used for all reversing. There are two submodes; Protected Reverse and Unprotected Reverse. The ATP Controller provides limited protection to the train, the degree of protection depending upon the sub-mode.

Standby Mode

ATP Controller operation is limited to monitoring of inputs and provision of a limited amount of output information. Note that an ATP Controller in standby mode in an active cab remains registered with an MBP; an ATP Controller in standby mode in an in-active cab does not.

The following terms are used when discussing ATP Controller functionality:

Full Protection Mode

Refers to the Protected Manual and Manned Automatic train modes. When the train is operating in full protection mode, the ATP system is giving the maximum possible protection that it can deliver.

Limited Protection Mode

Refers to the Standby, Restricted Manual and Reverse train modes.

The ATP Controller is configured with the knowledge of the characteristics of all types of train to which it may be fitted. It reads a hard wired (but configurable) set of links from its train interface that indicate the type of train. This allows the ATP Controller to 'look up' certain train characteristics such as emergency brake rate, emergency brake response times, acceleration characteristics and the train length. This data is predominantly used by the ATP Controller when performing its emergency braking distance calculations.

Train Length is passed to the MBP where it is used when issuing LMAs up to the rear of trains. Some trains have variable length—engineers' trains for example. In these cases the train length value will be assigned as 'unknown'. This will be conveyed to the MBP which will assume that the train is a default length, the default being set, for safety, to the length of the longest train that will run on the line.

The main components of the present system are the MBPs and the train-carried ATP and ATO systems. These components are supported in their operations by other infrastructure components which supply them with information or which convey information between them. The infrastructure components will now be described in detail.

The combination of trackside transponders (11 in FIG. 2) and train-carried transponder readers (12 in FIG. 2) which serve the ATP Controller is known as the Absolute Position Reference (APR) system. The primary function of this system is to provide each ATP Controller with its absolute position within the railway network. The APR system is also used to convey the 'closed'/'not closed' state of platform edge doors (PEDs) (13 in FIG. 2) to an ATP Controller at stations equipped with PEDS.

The trackside part of the APR system consists of transponders placed between the running rails. Each transponder contains a unique APR code which is transmitted to a passing train so that the ATP Controller can deduce its absolute position at that instant. No indication of the direction of travel is given. The train-carried APR unit comprises an antenna, a transponder reader (which interrogates the transponders) and a test tag (which is used to test the transponder reader). The APR unit is under the control of the ATP Controller.

The availability of the APR system is essential to the operation of the present system. Dual independent transponder readers are therefore provided for each ATP Controller. The test tags in the APR unit produce outputs similar to those of a transponder, but with a unique test identity. The tags are used by the ATP Controller to test the transponder readers in both self-test and normal operation.

Three different layouts of trackside transponders are used; the choice depends on the particular situation. These cases are now considered in turn.

Single transponders

Figure 6:
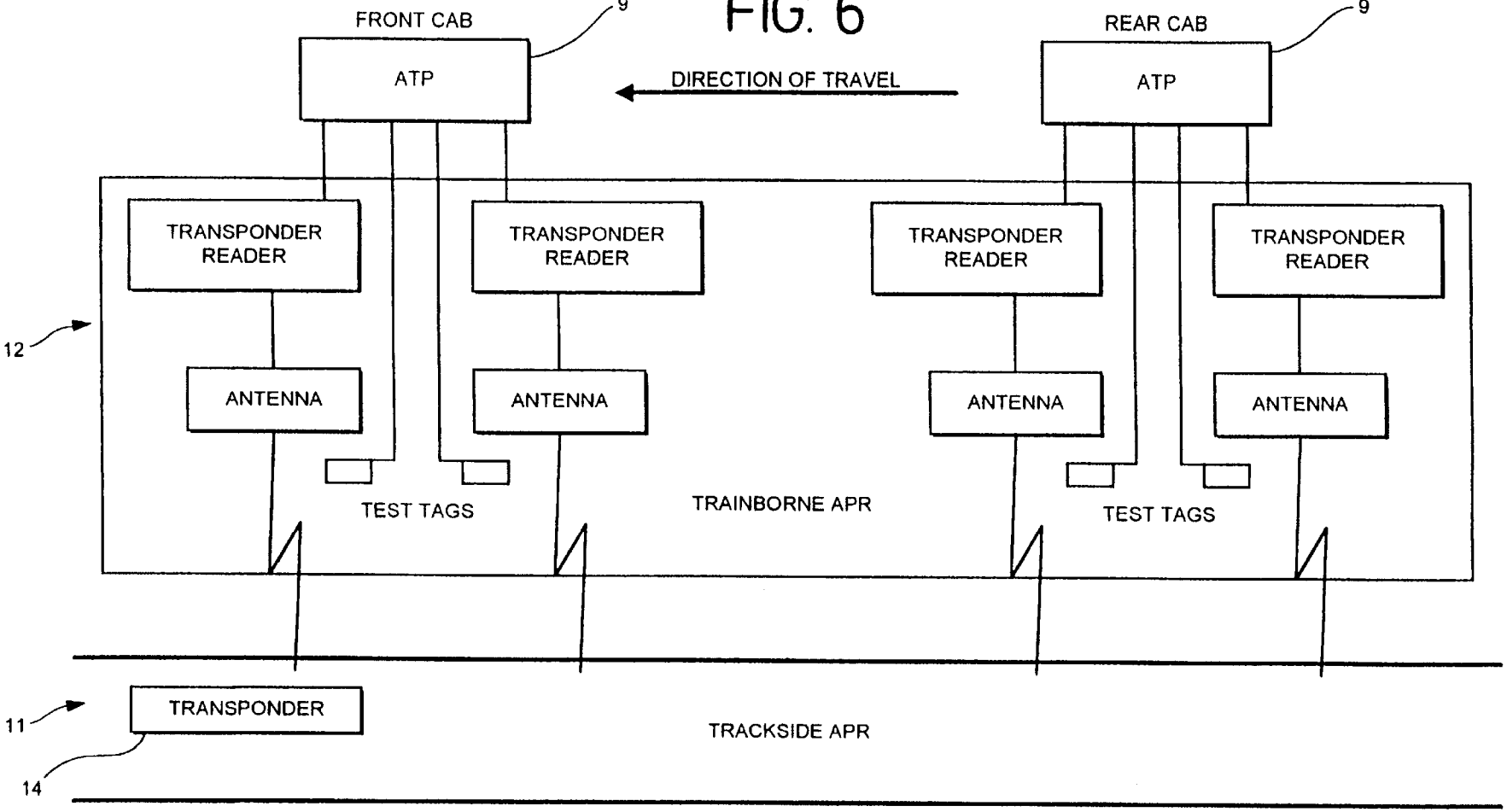
FIG. 6 illustrates a single position transponder layout.

These are placed at intervals along the track and in the vicinity of divergences, as shown in FIG. 6. They require no external connections. As the train passes a succession of single transponders 14, the ATP Controller 9 can deduce the distance moved and direction of travel.

Figure 7:
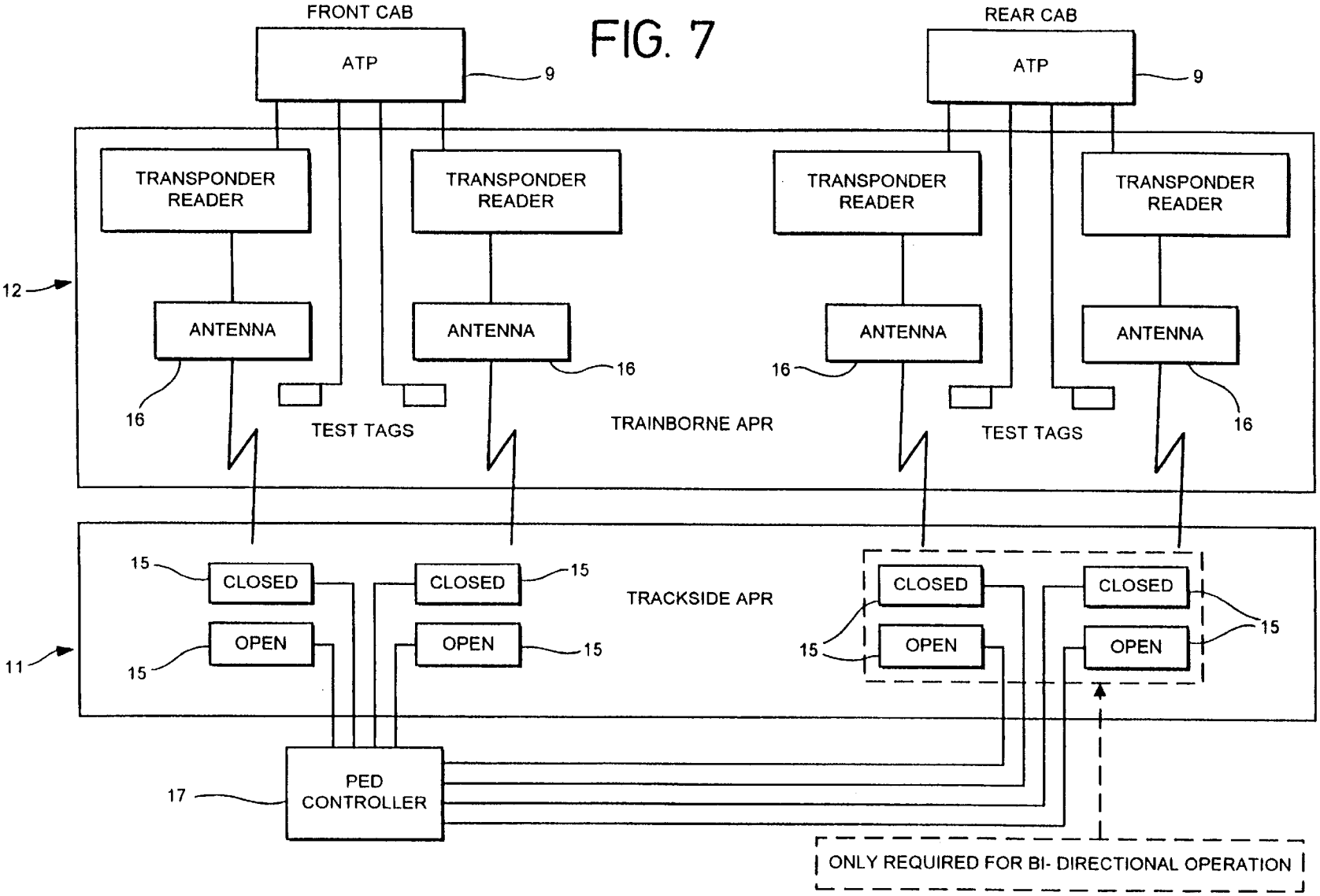
FIG. 7 illustrates an externally controlled transponder layout.

Externally Controlled Transponders (ECT)

Where the APR system is used to convey the closed/not closed state of PEDs at a stopping point, four complementary pairs of Externally Controlled Transponders (ECT) 15 are used as shown in FIG. 7.

The complementary pairs are placed side by side.

Each pair is positioned to align with one of the train-carried APR antennas 16 when the train is accurately stopped (i.e. two transponders under each antenna). One transponder of the pair is enabled by the PED controller 17 to indicate 'closed' and the other can be enabled to indicate 'not closed'. The 'closed' and 'not closed' transponders will not be activated at the same time.

The active ATP Controller 9 will not enable the train doors unless it can read at least one ECT (the status of which may indicate either 'closed' or 'not closed'). To allow the train to depart, the active ATP Controller must see a transition from 'not closed' to 'closed' after the train has stopped.

The ATP Controller only requires to read one ECT to determine the PED status, hence the above two functions remain available in the event of either an ECT failure or the failure of one of the two train-carried APR units. However, if the ATP Controller can read the PED status from each APR unit, then status indicated by both must agree. If they disagree for longer than a configurable period, the ATP Controller will declare the status as "unknown" and request the emergency brakes.

At platforms with no PEDs, no special transponders are required. The ATP Controller deduces its location—and hence whether to enable train doors—from previous transponder readings and from tachometer and Doppler information provided by the Speed and Distance Measurement System (SDMS).

Transponders at stabling locations

This layout is employed at places where the ATP Controllers are to be powered up, but where the previous layout is inapplicable because PEDs are not present. Normally after power-up, the ATP Controller must move over at least two individual transponders in order to be sure of its location and direction. This is the method used to determine location for trains entering the railway from a depot.

Figure 8:
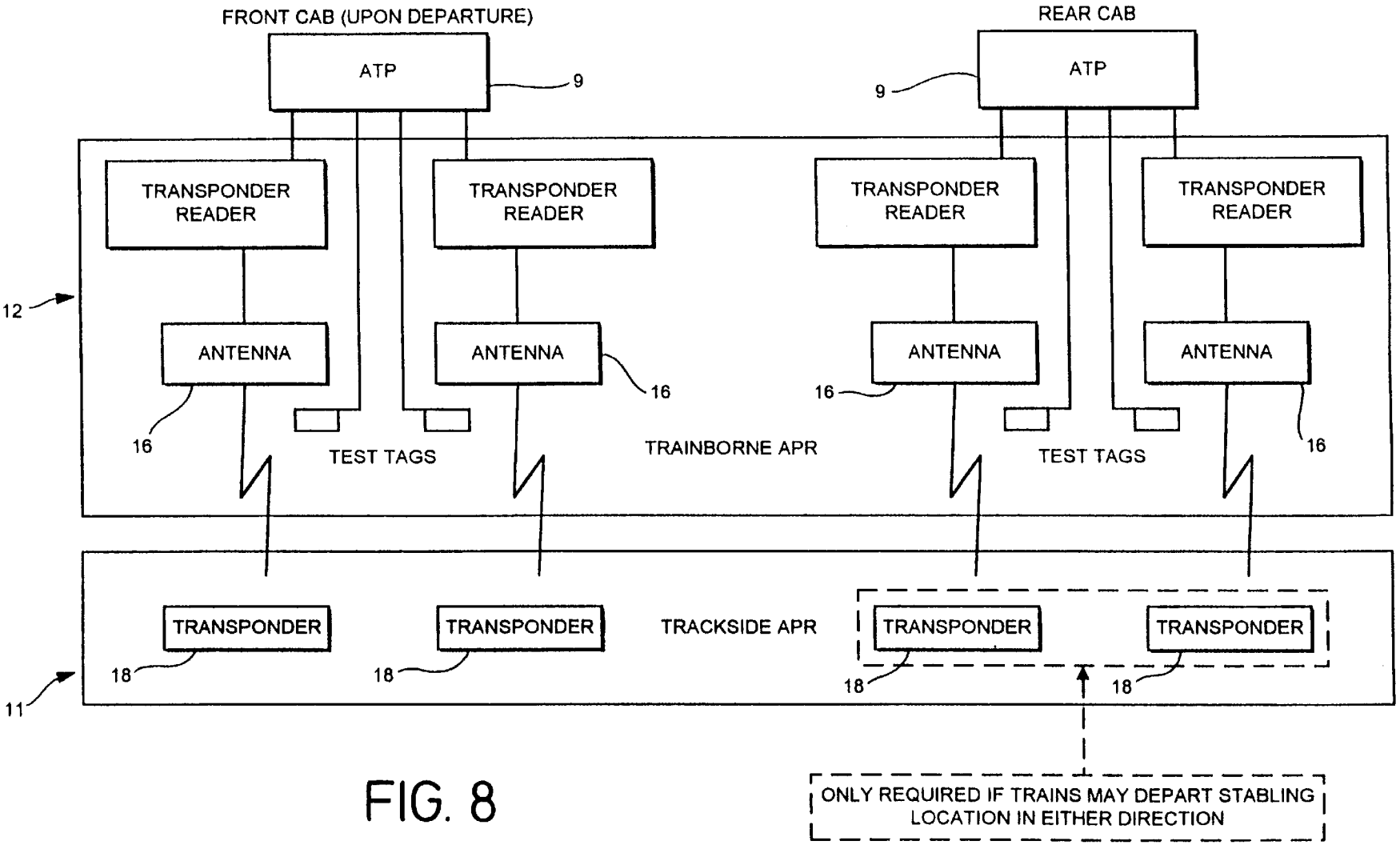
FIG. 8 illustrates absolute position reference apparatus at stabling locations.

However, at mainline or siding locations where overnight stabling (and hence power-down) is a regular occurrence, transponders 18 are placed so as to line up with the train-carried APR antennas 16—as shown in FIG. 8. To enable location and direction to be established without moving the train the active ATP Controller 9 must receive compatible information from both its sets of train-carried APR equipment.

Each MBP permits the input of commands that modify the way it protects its MBP Interlocking Area. The MBP is responsible for remembering and applying the modifications. Control is accessible from the following components of the present system:

Discrete Interlocking Inputs (DII)

Control Terminal (CT)

Service Control Centre (SCC)

Station Information Management System (SIMS)

The control operations which are offered by the MBP include:

Apply a restriction (e.g. a TSR or emergency stop area).

This is applied to a specified area of the track (i.e. either a configured area or a temporary section). The SCC and SIMS are not permitted to apply TSRs.

Activate a pre-configured restriction (e.g. TSR, single-train section).

Override a failed detection section.

Remove a specified restriction or override.

Deactivate a preconfigured restriction.

Define or remove a temporary area.

(If a particular section is required for a restriction and the configured sections are not suitable, then a temporary section can be defined).

Display temporary data (e.g. TSRs, temporary areas).

The control terminal possesses security features to deter unauthorised use and to minimise user errors. It can also remove restrictions imposed by the SCC or SIMS.

Each applied modification is given an identity by the MBP, which is used in the subsequent cancellation of that modification. Restrictions imposed by the control terminal can only be removed by the control terminal and restrictions imposed by discrete interlocking inputs can only be removed by the removal of the relevant input.

The Platform ATO Communicator 2 is the main part of the trackside ATO equipment. A PAC is generally associated with a station. The PAC exchanges information with the active ATO Controllers on stationary trains at ATO Communication Positions (ACPs); e.g. train status information from the train, driving strategy information from the SCC to the ATO Controller.

The PAC also:

acts as a conduit for TMS-to-SCC information;

uses its communication system to provide position markers for approaching trains.

Figure 9:
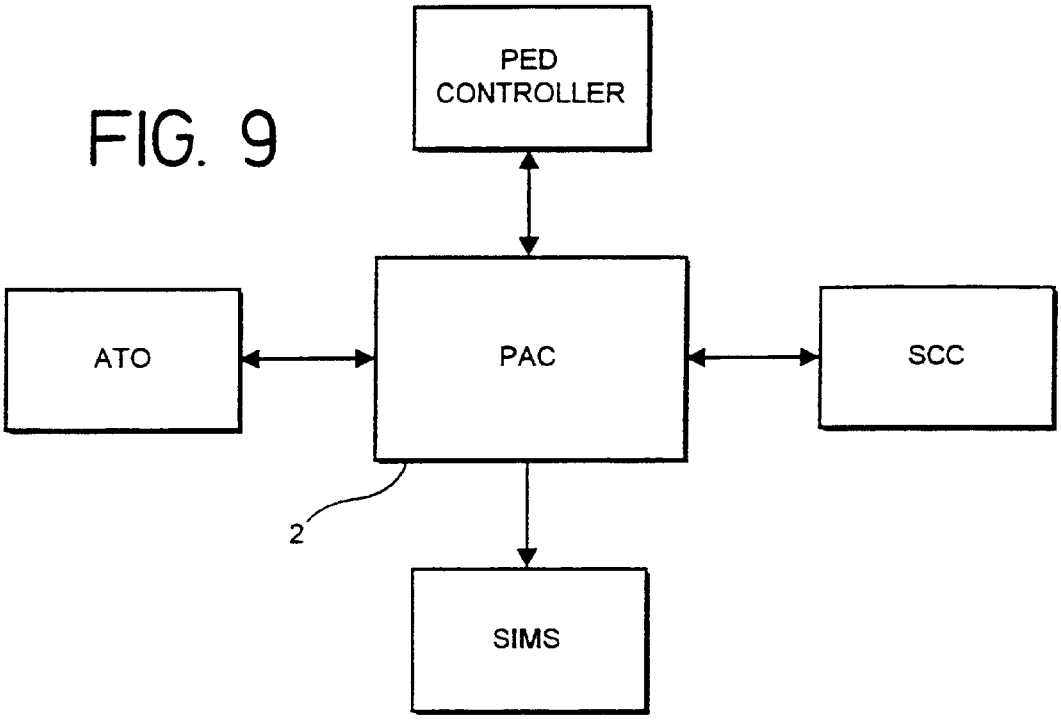
FIG. 9 illustrates a platform automatic train operation controller (PAC) generally.
Figure 12:
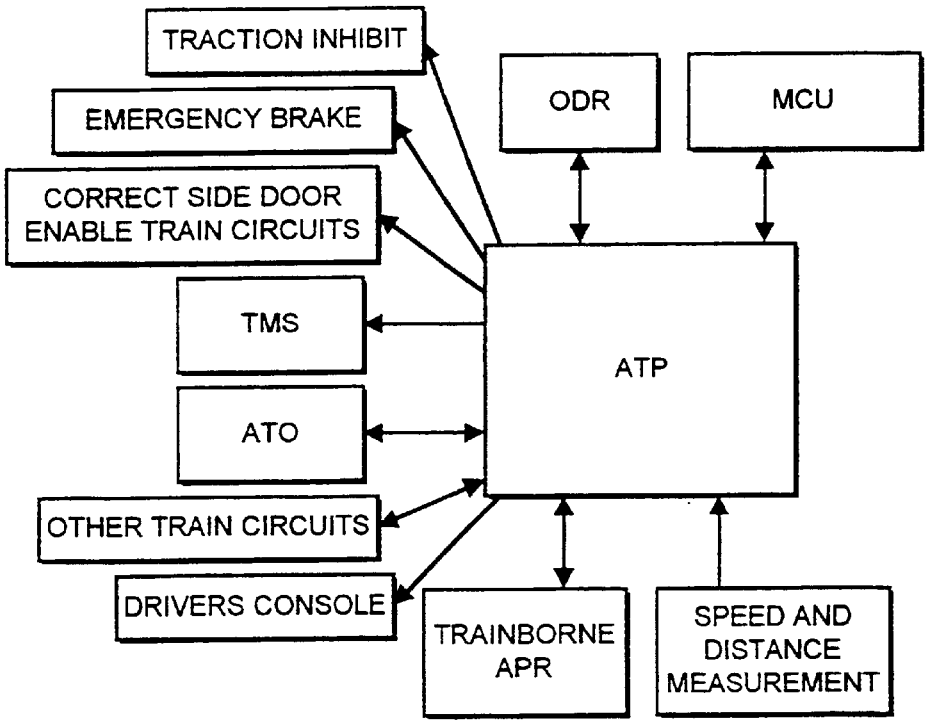
FIG. 12 illustrates an ATP controller generally.

The main functions performed by the PAC 2 (which is illustrated in FIG. 9) are:

Creating distance markers for the ATO system of an approaching train by sending continuous signals.

This enables the ATO system to re-calibrate its distance and speed measurements and hence to perform an accurate station stop.

Providing a communications path between a train and the SCC. The train sends the SCC train details on arrival and whenever the details change. Data may then be exchanged between the TMS and SCC via the ATO system and PAC.

Controlling the PEDs when commanded by the train ATO system. The PAC obtains the PED closed/not closed status from the PED Controller and passes it on to the ATO system whenever it changes.

Providing the current system time to the train. If the PAC has not received the time from the SCC, it accepts the time from an ATO system if available.

Generating a movement request for the ATO system based on that received from the SCC.

Passing location information to ATO Controllers during their initialisation procedure.

Storing error reports and events.

Reporting train details to the SIMS.

The Speed and Distance Measurement System (SDMS) provides information to the ATP Controller. It consists of tachogenerator (tacho) and Doppler measurement sensors (Dopplers). Each tacho and Doppler are duplicated for availability, thus there are two tachos and two Dopplers per ATP Controller. The SDMS sensors are used by the ATP Controller in order to derive velocity, direction and relative distance (i.e. since last transponder).

The tacho consists of a housed toothed wheel which rotates in sympathy with the train wheels. Two proximity sensors in each tacho detect rotation of the toothed wheel and thus produce output signals with frequency proportional to speed. (The use of two sensors in each tacho allows direction to be derived). These output signals are amplified and squared off by a pre-amplifier circuit housed in a Tachogenerator Disconnection Box (TDB). The amplified signals are then output to the ATP Controller. There is one TDB per tacho.

The Dopplers use microwave technology in order to determine train speed. They are aimed directly at the track bed and thus provide a speed signal that is independent of any inaccuracies induced at the wheel to rail interface.

With the addition of transponder information (from the APR system), the ATP Controller can derive the absolute location of its train. The ATP Controller also detects and compensates for wheel slide. The ATP Controller's error in location is least when it has just recalibrated its position with a transponder, and increases with distance and with wheel slide.

The ATP Controller also uses its knowledge of the exact transponder locations to calibrate the SDMS. It does this by calculating a correction factor for each sensor.

There is a separate tacho and TDB which supplies the ATO controller. This allows the ATO to independently derive train velocity, direction and location. The ATO does not read Doppler information.

Note that the ATO recalibrates absolute distance at ACPs (on station approach) and does not read APR transponders. This independence (of tacho) and diversity (of recalibration) guards against common mode errors that may otherwise affect both the ATO and ATP systems.

Figure 10:
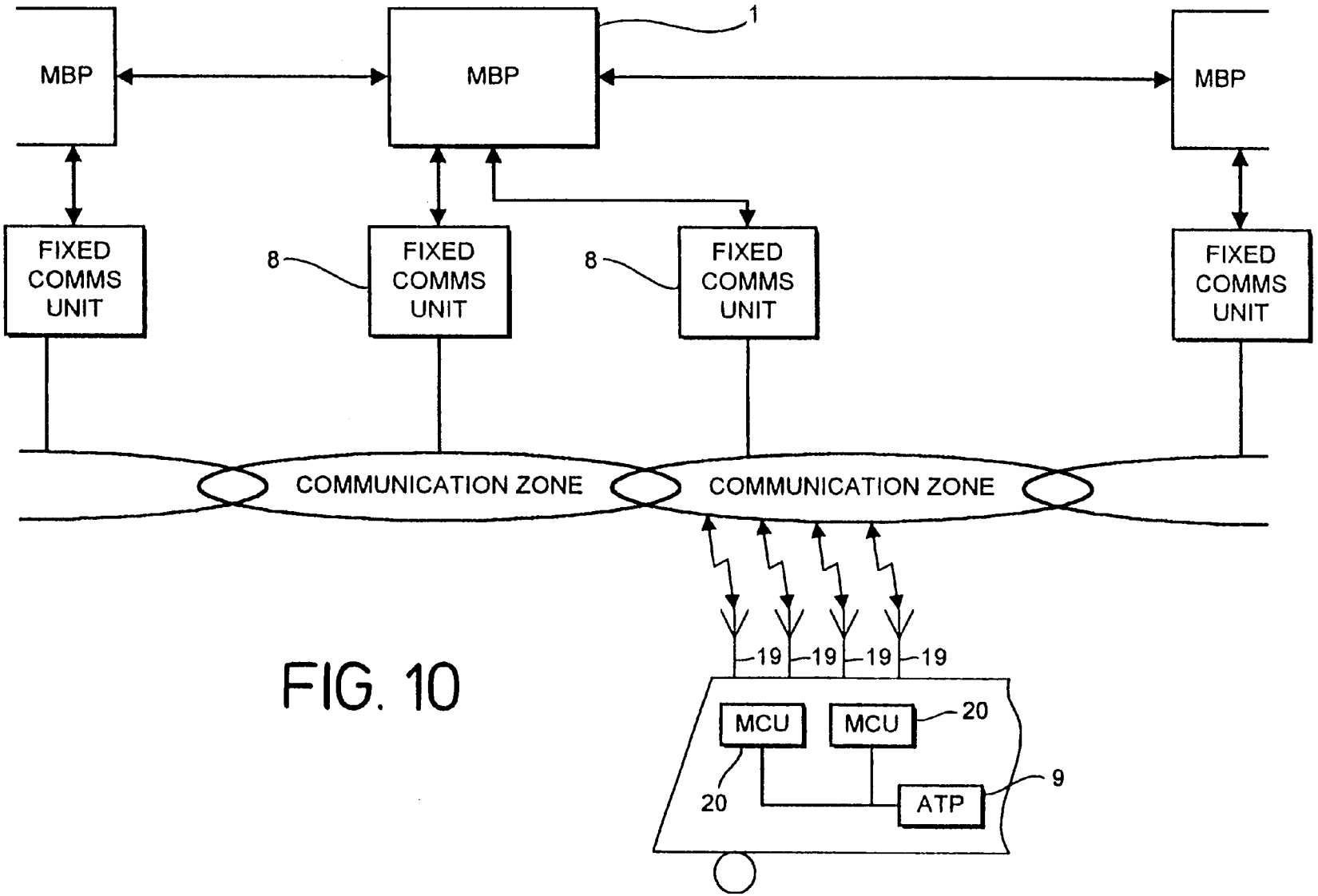
FIG. 10 illustrates an automatic train protection (ATP) communication system generally.

The ATP Communication system (illustrated in FIG. 10) provides a high-integrity, bi-directional data communications link between trackside MBP equipment and train-carried ATP equipment. This facilitates the simultaneous protection of a number of trains within each communications zone. The availability of the ATP Communication system is essential to the operation of the present system. Dual redundant interfaces are therefore provided for each MBP and for each ATP Controller.

The track is divided into a number of overlapping communication zones, each with a Fixed Communication Unit (FCU) 8; the overlap ensures continuity of coverage. There is generally one FCU per MBP 1. Where long distances are involved, several zones per MBP may be used. Adjacent zones use different frequencies, but the total number of frequencies required is minimised by appropriate reuse of frequency channels.

The trackside antenna consists of a series of leaky feeders, driven by the FCUs and running parallel with the track. A train-carried antenna is mounted on each of the four corners of the lead and rear cars of the train.

Two train-carried antennas 19 (from the same train side) feed into each Mobile Communications Unit (MCU) 20—the train-carried counterpart of the FCU. The MCUs are duplicated for availability. Only the lead car MCUs are active at any one time. The MCUs communicate with the ATP Controller.

Control of the ATP Communication System is provided on the trackside by MBPs and in the train cab by the ATP Controller. Note that an inactive ATP Controller does not communicate with the trackside.

Figure 11:
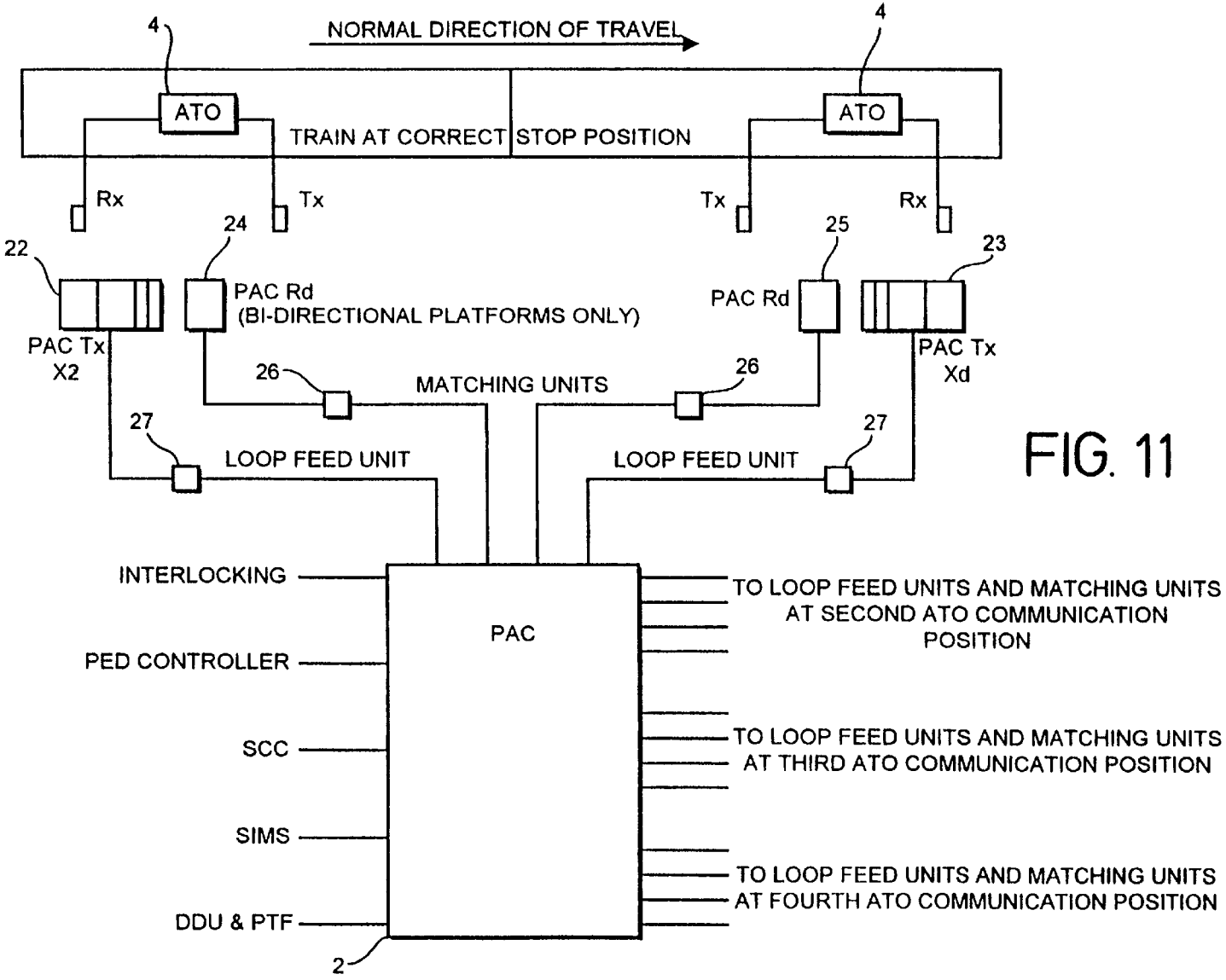
FIG. 11 illustrates a trackside automatic train operation (ATO) and PAC layout for an ATO communication position.

Referring to FIG. 11, the PAC 2 communicates with the train 21 via ATO Communication Positions (ACPs). An ACP is defined as a position on the track where a PAC and train-carried ATO can communicate. Physically, the communication is facilitated by a series of cable loops 22–25.

There are two transmitting loops 22, 23 per ACP. Each loop contains a marker which can be detected by the train-carried ATO and thus be used for distance recalibration. The marker is created by putting a transposition in the loop. Other transpositions are put into the loops in order that the marker may be uniquely identified regardless of the direction in which the loop is traversed. The loops are placed as follows:

With the marker of the first loop on the station approach, to allow an autodriven train to re-calibrate its position so as to achieve an accurate stop.

With the marker of the second loop 10 metres in front of the correct stop position of the train, to allow for a second "fine tune" recalibration prior to stopping. (In practice this means markers are placed symmetrically in the ACP to allow for bi-directional running of trains). This loop is positioned such that an accurately stopped train has a communication path to the PAC.

Sufficiently far apart to allow the Train-carried ATO to determine an accurate value for the wheel diameter.

The marker placed before the normal direction stop position is known as the Xd marker 23. The marker encountered before the Xd marker is the X2 marker 22. For reverse train running, the marker names are interchanged.

There is a receive loop 24 placed at the correct stop position of the train, thus for bi-directional ACPs there will be two receive loops 24, 25.

To achieve impedance matching between the PAC and the loops, Matching Units 26 and Loop Feed Units 27 are used with the Receive and Transmit Loops respectively. Both types of Unit contain a transformer. The Loop Feed Units can also provide attenuation of the signal.

The line-side equipment at each ACP consists of X2/Xd transmit loops and loop feed units, and Rd loops as required with associated impedance matching units. The X2, Xd and Rd loops shall be mounted such that, when the train is positioned at the correct stopping position the train antennas at each end of the train are positioned over the relevant loop.

Each ATO Controller has two transmit (Tx) and two receive (Rx) antennas associated with it. These antennas are positioned on the train bogies such that they are directly above the trackside ACP loops when the train is accurately stopped at an ACP. The antennas are of the 'wound ferrite' variety.

The main ATP Controller operations can be summarised under the following sub-headings:

Protecting Trains

In order to provide protection, the ATP Controller performs the following top level operations:

Registration—In order for a train to be managed correctly by the MBP it must first become registered.

Derivation of Train Characteristics—In order to protect the train, the ATP Controller must be aware of the train characteristics, particularly those relating to the performance of the emergency brakes. The ATP Controller reads its train interface to find out the type of train to which it is fitted and uses this information to access the correct train performance parameters from part of its on-board database.

Handling of LMAs—The ATP Controller must obey LMAs issued by the MBP such that the train does not travel beyond the LMA. The ATP Controller exercises control by requesting that the train applies its emergency brakes when necessary.

Speed Restrictions—The ATP Controller must obey both PSRs and TSRs such that the train speed does not exceed a speed limit. Again, the ATP Controller exercises control by requesting that the train applies its emergency brakes when necessary.

Tracking Train Position—In order to perform LMA and Speed Restriction protection, the ATP Controller tracks position within its own on-board map using information from the SDMS.

Deriving Train Speed—In order to perform LMA and Speed Restriction protection, the ATP Controller derives train speed using information from the SDMS.

Door Control—The ATP Controller performs the safety critical functions of correct door side enable and preventing the train departing a PED equipped station with the PEDS open.

Roll Back and Roll Forward Protection—The ATP Controller requests that the train applies its emergency brakes when the train rolls backward when a forward mode is selected and when the train rolls forward and a reverse mode is selected.

Control of Reversing Manoeuvres—The ATP Controller provides limited protection to reversing trains.

Control of Restricted Manual Movements—The ATP Controller provides limited protection to trains operating in RM mode.

Train Complete Protection—The ATP Controller ensures that full speed train movements can only take place if the train is complete.

Distribution of LMA and TSRs to the ATO

This information is passed to the ATO as and when received from the MBP network.

Providing DrivinQ Information to the Train Operator

The ATP Controller outputs train speed and target speed to the cab console. The target speed information is used by the train driver when controlling the train in other than Auto mode. Other operational data is available to the cab console via the interface to the TMS.

Other Functions

The ATP Controller performs a number of functions in support of maintenance including: built in test, event logging to the TMS, event logging to the ODR, internal event logging, diagnostic access to BIT history etc.

On power-up, the ATP Controller performs a power-on self-test before it starts normal operation and subsequently performs a background self-test continuously during normal operation. The train driver, through the use of a switch in the train cab, may request the ATP Controller to perform a more comprehensive test if the train is stationary; the ATP Controller will deregister itself before the test is carried out.

A train is limited to Restricted Manual operation until it determines its location and direction and establishes communication with an MBP. The MBP then registers the train's ATP Controller. Once registered, the ATP Controller may be issued with an LMA. Once a train has an LMA it may enter a Full Protection Mode.

The active ATP Controller in a train can register with the MBP network after one of the following conditions is met:

- the train is driven into the MBP area under Restricted Manual mode (note that a train is limited to this mode until its ATP Controller is. registered);
- the train is in the area when the MBP is powered up.
- the train is in the area when the ATP Controller is powered up (and finishes its power-up self test).

Before an ATP Controller attempts to register with an MBP, it carries out certain checks, for example that the ATP Controller is active and functioning correctly, the train is complete and that the location and direction of the train are known.

The MBP is responsible for deciding whether to register an ATP Controller. If the registration is successful and the ATP Controller subsequently becomes deregistered, it will attempt to register again when all the necessary conditions are once more met.

Deregistration of an ATP Controller may be initiated by either the ATP Controller or the MBP. An ATP Controller may deregister itself if communications with the MBP are lost or for a variety of other reasons, e.g. ATP Controller can no longer be certain of train position.

If the ATP Controller subsequently receives a message from the MBP, it informs the MBP that it is deregistering and replies to any further messages from the MBP with this deregister message.

If the MBP deregisters the ATP Controller, then the MBP notifies the ATP Controller of the deregistration. The MBP informs the ATP Controller of the reason in the deregistration message.

On receiving a deregister message citing "inconsistent location" as the reason, the ATP Controller discards its absolute location information and recalculates its location when sufficient APR information is available.

The ATP Controller regularly (about once a second) carries out a worst-case emergency braking profile calculation which is based on the emergency brake performance of the train and the track geography. The calculation includes all necessary offsets and safety margins.

To perform this calculation, the ATP Controller must know where the train is and so must track its position within its own internal map. This involves the use of the APR and SDMS systems.

Having calculated the worst case stopping distance, the worst case stopping location can be derived and compared with the LMA. If this stopping location is beyond the LMA then the ATP Controller requests the emergency brakes. In this case, the calculation appears to predict that the train will overrun the LMA. However, the calculation is designed to 'look ahead' one cycle, and therefore predicts the worst case stopping location should the emergency brakes be applied at the end of the next cycle. This effectively means that the ATP Controller requests the emergency brakes one cycle before the worst case stopping location exceeds the LMA. Consequently the train will not actually exceed the LMA.

Note that there are many reasons dictating the position of the LMA as issued by the MBP. However, the ATP Controller is unaware of them and therefore effectively interprets each LMA as a fixed obstruction.

The ATP Controller ensures that the train speed cannot exceed the limits of any approaching PSR or currently active TSR.

When an upward change of speed limit occurs, the ATP Controller ensures that the old (low) speed limit is enforced.until the rear of the train is clear of it.

During the repeatedly performed worst-case emergency braking profile calculation, the ATP Controller compares the calculated projected speed profile with all approaching speed restrictions. If this profile infringes any approaching speed limits (PSR or TSR) the ATP Controller requests the emergency brakes.

The ATP Controller performs train door and PED control and monitoring functions in conjunction with the ATO and the PAC. The ATP Controller's role is to perform the safety critical functions as follows:

For platforms with PEDs, the ATP Controller enables the train doors on the correct side of the train providing that the train is stopped and the ATP Controller can read the specially located transponders i.e. the ECTs.

For non PED stations, the ATP Controller enables the train doors on the correct side of the train providing that the train is stopped within a configurable distance of the correct stopping point.

The ATP Controller observes the state of the PEDS via the Externally Controlled Transponders (ECTs) of the APR system. If the PEDs are not seen to change from 'not closed' to 'closed' then the ATP Controller prevents train movement by means of a "Traction Inhibit" output which feeds into the train's traction circuits. This effectively prevents train movement until the PEDs are closed.

The ATP Controller provides protection against wrong direction movement as follows:

Reverse mode—The ATP Controller requests the emergency brakes when the train moves forwards more than a configurable distance.

All other modes—The ATP Controller requests the emergency brakes when the train moves backwards more than a configurable distance.

In Restricted Manual mode the train speed is limited to a configurable speed. If this speed is exceeded the ATP Controller requests the emergency brakes.

The ATP Controller does not perform the worst-case emergency braking profile calculation in RM mode and therefore does not react to either LMAs or speed restrictions.

The ATP system supports two types of reversing: Protected Reverse and Unprotected Reverse. The two sub-modes differ in how the restriction of the train to the reversing area is enforced. However, in either sub-mode, if a reversing train exceeds the configurable maximum reversing speed, the ATP Controller requests the emergency brake.

The map data possessed by each ATP Controller contains those stopping points (and the associated protected reversing areas) at which protected reversing is allowed. These coincide with station platforms. The use of Protected Reverse Mode allows trains that overshoot the platform by up to a configurable distance to reverse back to the correct position whilst still being protected by an LMA.

When reverse mode is selected by the train driver, the ATP Controller checks whether the train is within a designated Protected Reverse Area. If Protected Reverse is not allowed at that location, the ATP system disables the train motor; if the train moves, the ATP Controller requests the emergency brake.

Figure 13:
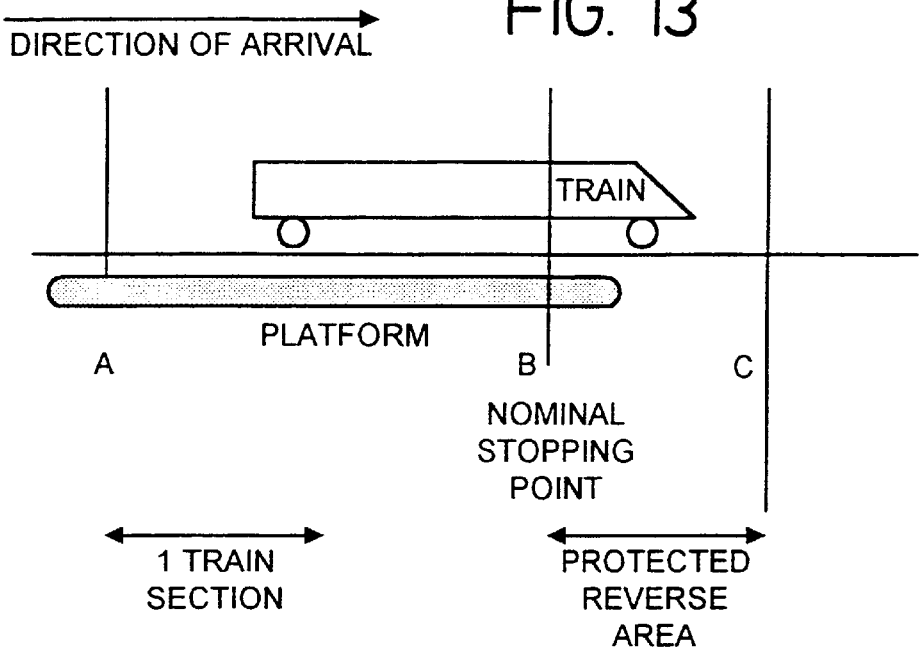
FIG. 13 illustrates a train undergoing protected reversing.

In protected reverse mode, the ATP Controller allows the train to reverse to the previous stopping point (point B in FIG. 13) if the train has subsequently stopped such that its front lies in a "Protected Reverse Area", i.e. between B and C. If, when reversing, the front of the train moves back beyond B, the ATP Controller requests the emergency brake in order to prevent the train rear from moving back beyond A.

Note that the "protection" is provided by configuring the MBP with a "One Train Section" (as shown) such that the LMA of a following train is limited to point A until front of the leading train clears point C.

Because the position of the rear of the train is important, protected reversing is possible only for trains of known length.

If a stationary train is in Reverse mode, the Unprotected Reverse mode may be selected by the train driver; this selection is ignored under any other circumstances.

If the deadman's handle in the rear cab (i.e. the one which is now leading in the reverse direction of motion) is not enabled, unprotected reversing may take place up to a configurable maximum distance (about 30 m). Reversing over a larger distance than this may be accomplished by stopping the train at or before the end of the initial reversing area and reselecting Unprotected Reverse mode.

If the deadman's handle in the rear cab is enabled—either when unprotected reversing is selected, or subsequently—then there is initially no limit on the reversing distance. If the deadman's handle in the rear cab is released at any time during unprotected unlimited reversing, the ATP Controller requests the emergency brake. No further movement is allowed by the ATP Controller until Unprotected Reverse mode is reselected or another mode is selected.

Because a train which is performing unprotected reversing can in principle encroach onto the current LMA of another train, operating procedures must be established for the safe use of unprotected reversing.

In a moving block system, LMAs are issued up to the rear of trains. In order to establish the position of a train rear, the MBP subtracts the train length from the reported position of the train front. If a train becomes incomplete (splits in half), this calculation is no longer valid, and the ATP system must take protective measures.

Therefore, should a train become incomplete (i.e. train split in half) the ATP Controller requests the emergency brakes be applied and de-registers itself.

The removal conditions for any emergency brake request initiated by the ATP Controller are configurable. The following events, or a combination of them, have the potential to remove an emergency brake request.

Condition clear—i.e. the potentially hazardous event that caused the brake application no longer exists.

Train stopped

Driver acknowledgement—the train driver makes an acknowledgement to the ATP Controller via a cab control. Examples of configuration are:

Overspeed (auto mode)—Condition Clear (i.e. no longer overspeeding) AND Train Stopped AND Driver Acknowledgement.

Overspeed (PM mode)—Condition Clear (i.e. no longer overspeeding) Driver Acknowledgement.

LMA infringement (i.e. the worst case stopping location predicted by the ATP exceeds the LMA) (Auto and PM modes)—Condition Clear (i.e. worst case stopping location no longer exceeds LMA) AND Train Stopped AND Driver Acknowledgement.

Figure 14:
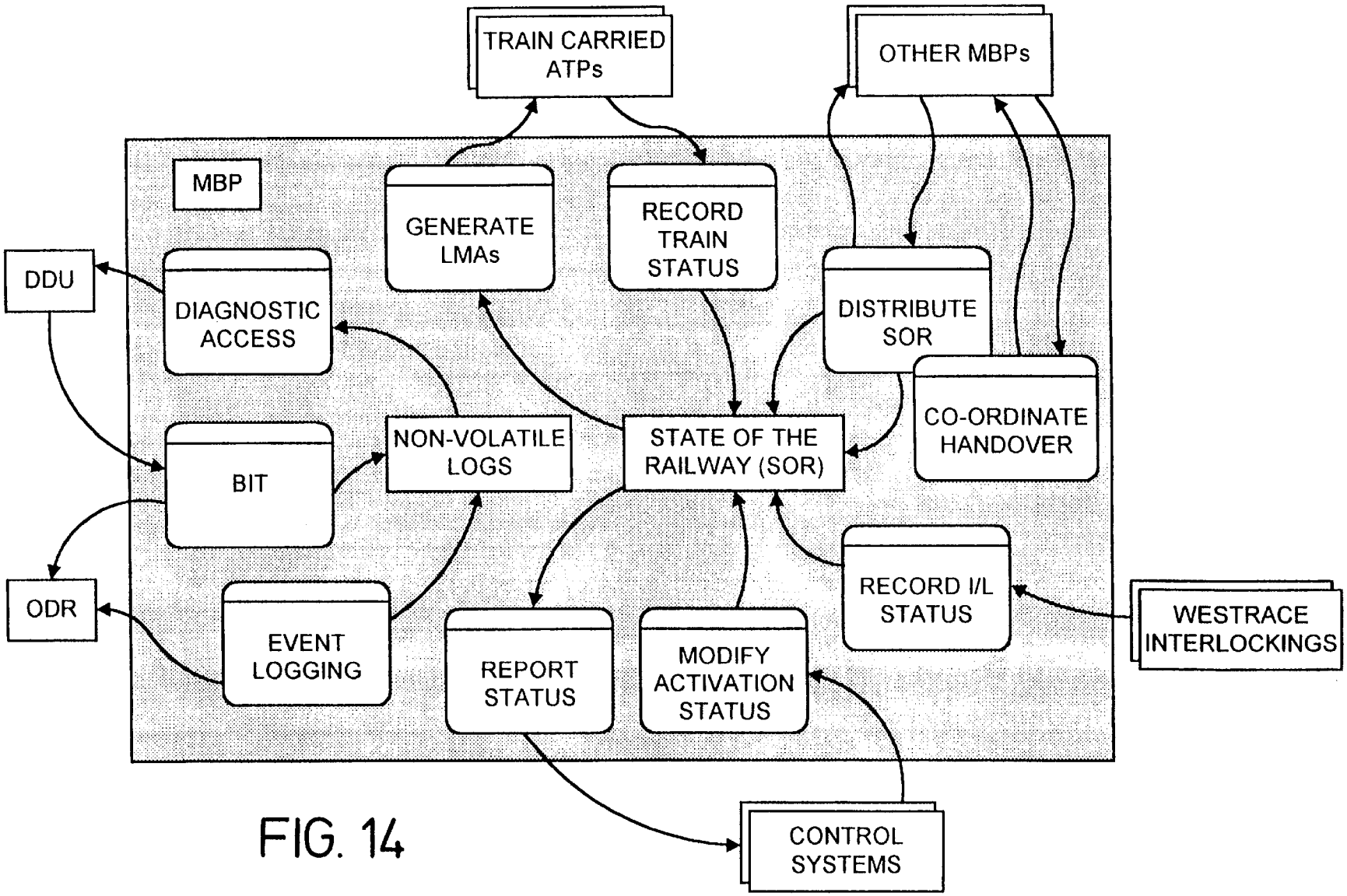
FIG. 14 is an overview of a moving-block processor.

The major aspects of MBP functionality will now be described. FIG. 14 is a functional block diagram of the MBP showing major information flows. The main MBP operations can be summarised under the following sub-headings:

Protecting Trains

In order to provide protection for ATP equipped trains, the MBP performs the following top level operations:

Registration—In order for a train to be managed correctly by the MBP it must first become registered.

Proving Clear—Once a train has been registered the MBP will attempt to prove it clear in front and behind using detection section information. This operation is intended to avoid situations where un-registered or un-equipped trains are lost and registered trains given unsafe authority to occupy the same area of railway.

LMA Generation—Once trains are proved clear ahead it may be safe for them to be issued with an LMA. An LMA is calculated by searching forwards until one of a number of obstructions is encountered in the MBPs State Of the Railway (SOR) database. The LMA is Limited by the nearest of these obstructions.

Maintaining SOR—In order to ensure that trains are protected according to the latest real state of the railway the MBP is required to maintain the SOR database in line with changes in reported train locations and information from the interlocking.

Speed Restrictions—From time to time it will be necessary for temporary speed restrictions to be applied to sections of the railway. It is the responsibility of the MBP to ensure that these are communicated to the train.

Track to train communication & routing

The MBP provides a mechanism to support high integrity communication between track side and train-carried protection systems. Since MBP areas of control must overlap but MBP communication areas do not, it is inevitable that an MBP will from time to time be required to communicate with a train outside its communication area. In this situation it is the responsibility of the MBP to route messages via an alternative MBP in order to achieve the appropriate end to end communication.

Distribution of SOR

It is likely that some of the information making up the SOR that an MBP uses to protect trains under its control will not be directly available but be sourced from other MBPs. An MBP must therefore distribute the necessary information to other MBPs.

Handing over trains between MBPs

As trains move through the network the MBPs interact with each other to propagate the responsibility for controlling a given train to the MBP best placed to do so.

Support Operator Control & Status Monitoring

The MBP provides multiple connections for external control systems. These allow the various support functions to be set-up and monitored as necessary.

Other Functions

The MBP will perform a number of functions in support of maintenance including: built in test, event logging, diagnostic access to BIT history etc.

An MBP is initialised after a failure or planned shutdown. Before an MBP starts to register trains, it waits for a configurable time (approximately two minutes) to ensure that any trains moving within the system have stopped.

Following this, the MBP transmits a message to all trains and to all connected equipment (including adjacent MBPs). This ensures that any previous communications from the MBP are now treated as invalid. The MBP may then start registering trains.

An MBP will periodically broadcast an MBP Status Message which, if the MBP has not exceeded its capacity (for example sixteen trains) will indicate that registration is available. On receiving this message an ATP Controller which knows its location on the railway will attempt to register. An MBP on receiving an ATP status message will perform basic validation operations and if successful will register the train. The train information is now logged in the MBP database and the specific train can be issued LMAs on a regular basis. Note that trains may only be registered if they are wholly within an MBP Area Of Control.

In fault or abnormal circumstances, trains may be deregistered by the MBP. This may occur upon request by the ATP.

After an ATP Controller is registered, the train will be limited to Restricted Manual operation, until the MBP generates an LMA and thus permits the ATP Controller to provide full protection.

In order for the MBP to grant the initial LMA to an ATP Controller the ATP Controller must be registered and the MBP must prove that there are no other trains "hiding" in front of the train (see below).

When the MBP has checked these conditions, it can send the ATP an LMA which under normal circumstances will be updated by the MBP until control is passed to an adjacent MBP.

Proving Clear Ahead. Before generating an LMA for a train it is necessary to ensure that there are no unregistered or unequipped trains (immediately in front of the controlled train) which are undetected due to being hidden in the same track circuit. The MBP therefore attempts to prove clear ahead all registered trains.

Proving Clear Behind Before allowing the LMA of a train to extend up to the reported rear of the preceding train, the MBP must ensure that there are no unregistered or unequipped trains hidden in the track circuit immediately behind the preceding train. The MBP therefore attempts to prove clear behind all registered trains.

Detection of Hidden Trains In order to establish that there are no hidden trains, the location of the train is compared to detection section boundaries. If a train is within a configurable length (approximately the length of the smallest unit of rolling stock) from a detection section boundary, there cannot be another whole vehicle between the front of the train and that boundary (though there could be a part of a vehicle). If the adjacent detection section is clear, it can be assumed that there is no vehicle immediately in front of the train.

Once a train is registered, proved clear ahead and suitably positioned (e.g. not over an undetected set of points) the MBP generates LMAs using one of four types of LMA Message:

Start of LMA. This message is sent both to give the train its first LMA and to notify the train that the ordinary generation of LMAs is re-starting after a cancel LMA situation has occurred.

LMA message. This is a normal LMA message which is sent when the train has an LMA and the LMA is either unchanged or has lengthened.

Shorten LMA. This message is sent when the new LMA is shorter than the last one sent to the train, for example due to a signal reverting to a non proceed aspect in front of a train. The LMA is never shortened to behind the last reported location of the train.

Cancel LMA. This message is sent when circumstances change and it is necessary to stop the train as soon as possible, for example when part of the train is over a set of points that become undetected.

The LMA which can be generated by the MBP for a train is limited by the most restrictive (i.e. closest to the front of the train) of many items. Simplified examples are as follows:

The LMA cannot extend beyond the nearest non-proceed signal.

The LMA will stay one clear train detection section behind a non-ATP train, an unregistered ATP train, or a registered ATP train which has not proved that there is nothing 'hiding' behind it.

If the MBP has proved that there is nothing 'hiding' behind a registered train, the MBP can let the LMA up to the reported rear of the train.

The LMA cannot extend beyond the MBP's area of control. Once handover of the ATP Controller is complete, the adjacent MBP will issue an LMA in its own area of control.

An LMA cannot occupy an N-Train Section if there are already 'N' trains which are either within the N Train Section or have LMAs which occupy it.

An LMA cannot enter a train clearance section unless the train can completely clear the section; i.e. the LMA must extend to one train length beyond the other side of the section.

An LMA cannot occupy a failed detection section unless it is overridden.

An LMA cannot occupy a TSR area where the TSR is active until the ATP Controller has acknowledged receipt of the TSR. The LMA reaching the TSR is the trigger for the MBP to send the TSR to the ATP Controller.

An LMA cannot occupy a failed Communications Zone. (Although the zones overlap to a small extent, there is a defined point where a zone starts and stops).

The MBP maintains TSRs and a record of whether they are activated or not. The MBP is responsible for communicating any active TSRs to any trains in its area of control. The trains LMA is not allowed past the start of the TSR until receipt of the TSR has been acknowledged.

The MBP supports two types of temporary speed restriction (TSR):

Pre-configured TSRs—these are configured into the MBP as configuration data and can only be activated and de-activated by discrete inputs through the interlocking. These are intended to be used in special situations such as when Platform Edge Doors fail to open.

Dynamic TSRs—these are defined by the external control terminal and can be activated by the other external control systems. Dynamic TSRs have to be defined before being activated. This definition can only be done by the control terminal associated with the MBP.

The MBP controls the number of trains within an N train Section by limiting the LMAS of approaching trains to the near end of the NTS until it is acceptable for the approaching train to enter. This is of course usually triggered by another train exiting the NTS.

The MBP will not normally issue an LMA anything less than a full train length beyond the end of a TCS, thus ensuring that trains will not, under normal circumstances, come to rest within a TCS.

Figure 15:
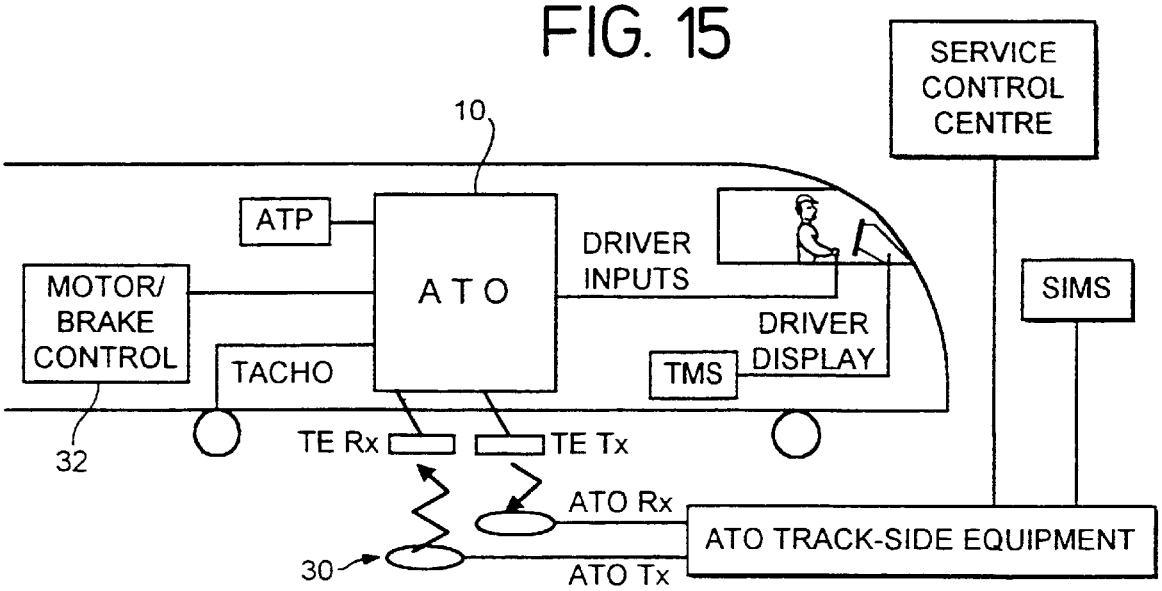
FIG. 15 illustrates an ATO system generally.

The main purpose of the ATO system (see FIG. 15) is to drive trains equipped with ATO Controllers 10 automatically in a forward direction from an auto-start position (where trackside ATO equipment 28 is present) along any predefined route to an auto-stop position. Such a movement is called an auto-run. It takes place under the supervision of the Service Control Centre (SCC) 27 and is conducted such that any driving strategy and/or headway requirements are fulfilled. Communication with the SCC is achieved by using transmitting and receiving units 30 positioned at all auto-start and most auto-stop locations. The train-carried ATO equipment contains an on-board map which enables the train to travel to all auto-stop locations.

The ATO system also takes part in the operation of train doors and Platform Edge Doors.

Autodriving is the process whereby an ATO Controller controls the motors and brakes 31 of a train; in particular it controls the train speed within the prevailing speed limits and in such a way that the ATP is not provoked into requesting the emergency brakes. The ATO system will only attempt to autodrive when the ATP Controller is working correctly and various other conditions for autodriving hold.

The ATO Controller autodrives between autostart and autostop locations.

An autostart location is a position from which the ATO Controller may initiate autodriving. Most autodrives begin at locations which possess trackside equipment from which the ATO system determines and validates the location and direction of travel for autodriving. However, providing the ATO Controller knows location and direction, an autodrive may be initiated from any location in the ATO Controllers on board map.

An autostop location is a geographical position at which the ATO system can stop the train automatically; it is not necessary for trackside equipment to be present. If trackside ATO equipment is present, then it will be used to provide a more accurate stop and to set up two way communication between the ATO and PAC once the train has stopped.

A signal stop location is an autostop which is encountered during interstation running. Signal stops are performed when the LMA distance is approached or an achievable zero temporary speed restriction is encountered. The interstation run recommences automatically (known as a signal start) once the restriction has cleared; the train driver is not involved.

The ATO Controller receives an LMA from the ATP Controller. This indicates to where an ATO system can proceed on the track and the route to be taken to this point, including all divergences.

The ATO receives TSR information from the ATP Controller.

The ATO Controller controls Platform Edge Doors by sending 'open' and 'close' commands to the PAC via the trackside loops at the platform.

The ATO Controller receives train information from the Train Management System (TMS). The ATO communicates this information to the SCC via trackside equipment.

The ATO Controller sends train information (such as dwell times and messages to the train driver) to the TMS. The ATO receives this information from the SCC via the trackside equipment.

The ATO Controller receives movement requests from the SCC. A movement request specifies the driving strategy for autodriving. The driving strategy indicates a simple selection of predefined coast vectors and deceleration rates. When no information is forthcoming from the SCC, the ATO Controller uses default movement request values.

The ATO Controller communicates ATO fault reports, TMS event data, and train identification to the SCC.

In order to autodrive a train, the ATO Controller requires four main types of information:

Geographical map data. Contains all information on track geography such as gradients, permanent speed restrictions, and autostop positions. This information is held in the ATO's on-board map. The ATO Controller uses trackside equipment in order to position itself with respect to the map data.

Protection information. The protection information includes an LMA, any temporary speed restrictions. This information is received from the ATP. The ATO performs a "shadow" ATP emergency brake calculation and uses the information gained to predict the point at which the ATP will intervene with an emergency brake request. This allows the ATO to drive the train without provoking the ATP.

Movement requests. The SCC supplies movement requests to the ATO Controller.

Distance and velocity. These are determined from the train movement and are used to maintain the train's position in the geographic map data. The information is derived from tacho inputs from the ATO tacho (which is separate to the two ATP tachos in the SDMS). In order to maintain autodriving availability, the train's position is tracked in all train modes except standby.

The ATO Controller tracks the train location by sampling a pulse train from the ATO tachometer. The distance is accumulated and the corresponding location in the map data is identified. By sampling on a regular period, the velocity of the train can be determined.

The ATO Controller recalibrates the train's position within the map by trackside markers. The trackside markers are used by the ATO system to correct for variations in wheel size (and hence to calibrate the ATO tachometer) by measuring the distance between markers and comparing it with the distance given in the map data. Finally, trackside markers are used on autostopping in order to improve the final stop accuracy.

The common data used by the ATP and ATO Controllers respectively is minimised in order to decrease the chances of common-mode failures of those Controllers. However, the Controllers must work together and so there is a need for a limited interaction. This interaction falls into two parts; 'Health and Status' and 'Data'.

The 'Health and Status' interaction is a regular communication (about once every second) where health and status information is exchanged between the Controllers. This information is the minimum necessary to allow the Controllers to operate in co-ordination. If one of the Controllers does not receive a message within a certain time, the other Controller is assumed to be unavailable. Certain messages are also used to indicate that a Controller has failed (either partially or totally).

The 'Data' interaction is the passing of the protection information (see above) from the ATP to ATO.

Where trains equipped with the train-carried apparatus necessary to the system described above are to share sections of track with un-equipped trains there is a need for refinements to the system described above. Only equipped trains may register with an MBP. While a train is registered with an MBP it periodically reports its location to the MBP. Registered trains may be given movement permissions by an MBP.

The system may be refined so that the MBP uses signal aspects and a route status from the signals to enable registered trains to be separated from un-registered trains or registered trains of unknown completeness.

In conventional fixed block signalling systems it is sufficient to use red and green signal aspects. For moving block another aspect, for example white, is introduced. The white aspect is interpreted as stop by all trains except those which are registered and being used in a Fully Protected mode, in which case the MBP uses its knowledge of other trains to determine whether or not the registered train may proceed beyond the white aspect.

The MBP receives signal aspect information from the interlocking. The MBP relies on the interlocking aspects it receives having the following meanings:

RED—all trains must stop

GREEN—the interlocking has set a route beyond a signal, and the route is empty

WHITE—the interlocking has set a route beyond a signal and the route contains one or more trains, none of which are within the signal replacement zone.

Note that, as detailed below, the "interlocking aspect" is not necessarily the same as the colour light displayed at trackside.

The route beyond or past a signal refers to the route protected by the signal. The route beyond a signal is also referred to as the route "in advance" of the signal.

Routes beyond signals will be given a status, the value of which will be dependent on the last train to enter the route. The status of the route is used in conjunction with the signal aspect to determine whether a registered train can be given permission to pass the signal and hence enter the route.

The status of a route will indicate whether a registered train may pass the signal protecting the route when the signal displays a white aspect (Proceed On White—POW) or only when a green aspect is displayed (Proceed On Green—POG). The term POG/POW describes the signalling scheme.

The routes which have a status within the MBP are different to interlocking routes, generally being the first part of the interlocking route. To avoid confusion an internal MBP route will be termed a POG/POW Route (PPR).

The trigger for a PPR status change is an event received from the Interlocking which indicates that a train has just past a signal and entered a route. The particular route which is set beyond the signal indicates which PPR has been entered. If the train is registered and of known completeness the status of the PPR is set to POW otherwise it is set to POG.

A PPR is an area of the rail network which is entered at a signal and exited at the next signal. A single PPR may have multiple entry points but only one exit point. Each entry point will act as a trigger for a potential state change for the PPR.

At the end of some PPRs, primarily those involving shunting, the PPR is not exited, the train stops at the exit signal. Therefore the exit point for a PPR may be a Fixed Red Light or the end of the section of track being considered e.g. for the Jubilee Line at the boundary with the Metropolitan Line.

A PPR is uni-directional, hence in a bi-directional area, there will be two disjoint sets of PPRs, one set for each direction. Like Interlocking routes, PPRs are not physically disjoint i.e. they can share parts of the rail network.

The relationship between interlocking routes and PPRs is many to one, that is trains entering several interlocking routes may affect the status of the same PPR. An MBP must be configured with the mapping between Interlocking routes and PPRs.

The MBP will associate a PPR with any signal with a route which can be entered via a white aspect or any signal with a route that converges with a route that can be entered via a white aspect.

The following signalling principles are assumed by the MBP in order to interpret Interlocking information.

It is the responsibility of the Control Centre, subject to agreement with the interlocking, to set routes as required.

All routes

A route may only be set if any points within it are not being used by any other route and the route to be set is clear (except for trains going away in the same direction as the route).

Conflicting route

Routes which conflict use the same section of railway with a different topology, i.e. use the same section of the railway network e.g. cross-overs, are prevented from being set at the same time by the Interlocking.

Opposing route

Routes which oppose, i.e. run the opposite way along a section of the railway network, are prevented from being set at the same time by the Interlocking.

Flank Protection

The Interlocking is expected to provide flank protection, via red signal aspects, as would be the case in a conventional signalling system.

It is the responsibility of the Control Centre to cancel routes when required. A route may only be cancelled if the Interlocking has detected the route or section of route to be cancelled is clear. If the approach locking area for a signal is not clear it may be timed off after a configurable period of time.

A route may only be released behind the last train within it. In other words the rear most train in a route must have cleared the sectional route release point, before the route can be changed.

This means that once a train enters a route another train cannot enter the route protected by a different PPR status until the previous train has travelled beyond the appropriate sectional release point.

Figure 16:
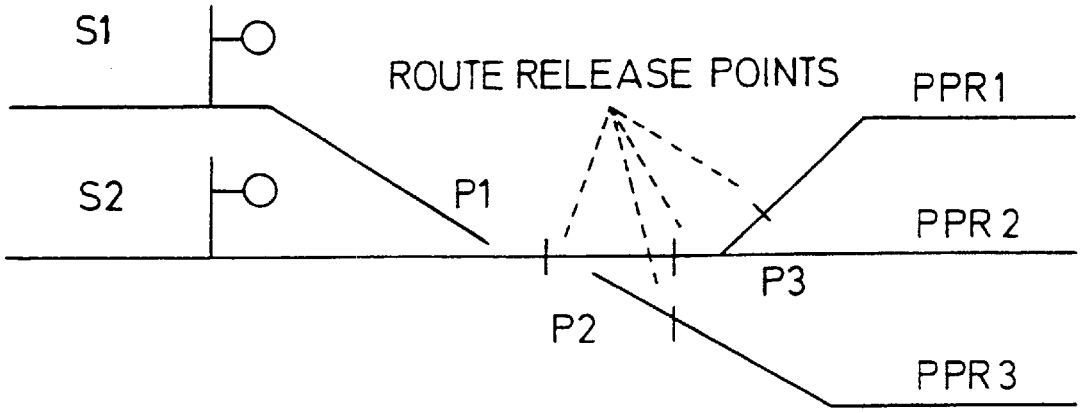
FIGS. 16 to 19 illustrate regions of railway track subject to signalling according to a preferred aspect of the present system.

Referring to FIG. 16, if (for example) a train has not passed the route release point for P1 then another train may only be allowed to enter the same PPR via the same signal. If a train is within a PPR and it has passed the route release point for P1 then another train may be allowed to enter the same PPR via either signal. If a train is within a PPR and it has passed the route release point for P2 or P3 then an alternative PPR may be entered.

The available types of signal will now be described. Of course, the precise details of the appearance of signal aspects given herein are merely examples.

Controlled signal

A Controlled signal is used by the Control Centre to hold traffic at the signal so that a route may be changed. A Control signal will have, as a maximum, the following aspects: red, white, green.

A controlled signal can be set to work automatically, with the route remaining set between trains, and the aspect determined by track occupancy like an Auto signal.

Auto signal

An Auto signal is used where there are no points (and therefore no routes apart from traffic locking). The signal aspect is determined by track occupancy. An Auto signal will have, as a maximum, the following aspects: red, white, green.

Phantom signal

A Phantom signal is an Auto signal with no physical lights. A Phantom signal will have, as a maximum, the following aspects: red, white, green.

Shunt signal

A Shunt signal is a controlled signal that never works automatically, it may be coincident with a main controlled signal. Shunt signals are used for low speed non-passenger moves.

A shunt signal has the following aspects: red, green (the signal actually displays a horizontal disc interpreted as red and a disc at 45 degrees interpreted as green).

The MBP needs to make allowance for the following types of signal:

Type 1—Signals with a WHITE aspect

Type 2—Signals with a RED and GREEN aspect

Type 3—Signals with a RED and GREEN aspect which allow entry to routes controlled by a WHITE aspect Type 4—Signals that are not physical signals but require the train to stop.

The MBP interprets the types of signal as described below:

Signals which have a WHITE aspect

These signals, because of the WHITE aspect, will have at least one PPR leading away from them. They must therefore always have a real replacement zone associated with them, as it is occupation of the replacement zone that provides the mechanism for PPR status to change.

The MBP uses the received interlocking aspect to limit a train's LMA as follows:

RED—LMA limited to the location of the signal

GREEN—LMA allowed to go beyond the signal

WHITE—POG—LMA limited to the location of the signal

POW—LMA allowed to go beyond the signal

For a type 1 signal the interlocking must pass to the MBP enough for the MBP to determine that a train might have entered a PPR:

Aspect (RED,WHITE,GREEN)—these must have the meanings listed above.

Train entered route—there are two cases where this can be active: (1) the replacement zone is occupied AND a route leading into a PPR is set; (2) the replacement zone is occupied AND no route is set from the signal (in this case, a train proceeding beyond a RED signal could enter a PPR—even if an opposing route was set). Nb "no route" does not mean "no route that enters a PPR" it means "no route at all"

Route set—tells the MBP which route is set from the signal. Information need only be provided for routes that lead into a PPR.

Signals with RED and GREEN aspects which allow entry to routes controlled with a white aspect Signals (real or phantom) that only have RED and GREEN aspects within the interlocking, but which allow trains to enter another non-opposing route that is controlled with a WHITE aspect.

Figure 17:
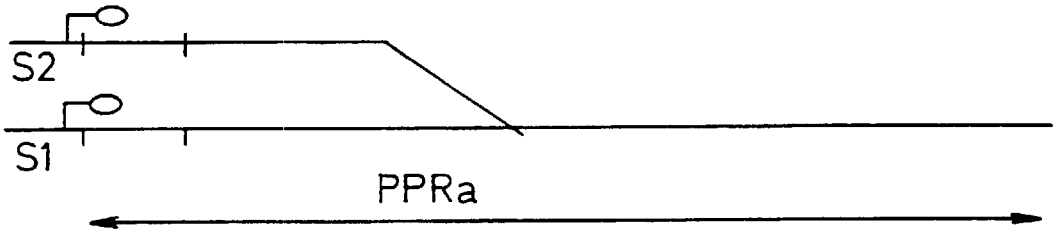

An example is shown in FIG. 17. S1 is a type 1 signal on a continually used section of the main line—i.e. it has a WHITE aspect, a replacement zone and controls entrance to a PPR (PPR a). S2 is used only infrequently. Because it is not headway critical, it has no WHITE aspect. However, trains passing S2 can conceivably enter PPR a. For this reason, the MBP needs knowledge of trains passing S2.

Although these signals do not have WHITE aspects, they can allow trains to enter a PPR. The MBP therefore requires them to have a replacement zone, so that entrance to the PPR in question can be controlled.

The MBP uses the received interlocking aspect to limit a train's LMA as follows:

RED—LMA limited to the location of the signal

GREEN—LMA allowed to go beyond the signal

For a type 2 signal the interlocking must pass to the MBP enough for the MBP to determine that a train might have entered a PPR:

Aspect (RED, GREEN)—these must have the meanings listed above.

Train entered route—there are two cases where this can be active: (1) the replacement zone is occupied AND a route leading into a PPR is set; (2) the replacement zone is occupied AND no route is set from the signal (in this case, a train proceeding beyond a RED signal could enter a PPR—even if an opposing route was set). NB "no route" does not mean "no route that enters a PPR" it means "no route at all".

Route set—tells the MBP which route is set from the signal. Information need only be provided for routes that lead into a PPR.

Signals that only have RED and GREEN aspects

Signals (real or phantom) that only have RED and GREEN aspects within the interlocking.

The RED aspect within the interlocking means that trains must stop. The GREEN aspect within the interlocking means the route is clear, all points locked etc.

Because these signals do not have WHITE aspects, they will not have PPR leading away from them. The MBP does not therefore require them to have a replacement zone, though there may still be one for other signalling purposes. Even if there is a replacement zone, there is no need for the MBP to be aware of its existence.

The MBP uses the received interlocking aspect to limit a train's LMA as follows:

RED—LMA limited to the location of the signal

GREEN—LMA allowed to go beyond the signal

For a type 3 signal the interlocking must pass the following to the MBP:

Aspect (RED, GREEN)—these must have the meanings listed above.

Signals that are not physical signals but require the train to stop

Signals (phantom) that are not signals at all—merely conditions that require the train to stop at fixed locations in certain circumstances.

An example here is a traction section. When a traction section is detected as having failed, trains should stop in front of it.

Because these signals do not have WHITE aspects, they will not have PPR leading away from them. The MBP does not therefore require them to have a replacement zone.

The MBP uses the received interlocking aspect to limit a train's LMA as follows:

RED—LMA limited to the location of the signal

GREEN—LMA allowed to go beyond the signal

For a type 4 signal the interlocking must pass the following to the MBP:

Aspect (RED, GREEN)—where RED means stop GREEN means do not stop.

The POG/POW signalling scheme assumes that some form of continuous train detection (e.g. track circuits) independent of the MBP and ATP is used to provide a green aspect signal and thus ensure a clear route ahead.

It is assumed that this method then provides the following benefits:

In normal running only the failure of the signal replacement track circuit will continually affect the operation of the MBP. Failure of any other track circuit will prevent a white aspect clearing to green on a protecting signal, this will not be a problem providing the status of the PPR(s) through the failed detection section are POW.

Continuous train detection allows the signalling system to determine whether or not a route is free from trains, allowing the MBP to protect un-equipped trains.

Continuous train detection aids system start-up and recovery after a failure as the location of trains on the network can be ascertained via signal aspects i.e. the signals identify the parts of the network that are occupied or empty.

The system does not guarantee protection against unregistered trains that perform unauthorised moves. For example, a registered train R1 will not be protected against an unregistered train U1 reversing towards it.

Figure 18:
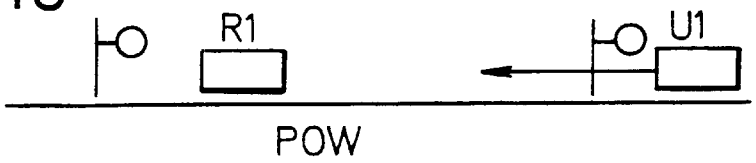

FIG. 18 shows U1 reversing into a PPR with POW status.

An un-registered train or a train in Restricted Manual mode must wait at a signal displaying a red aspect for a configurable time (e.g. 60 seconds) before the driver may proceed beyond the signal.

Registered trains will not take longer than the configurable time to drive through a replacement zone (otherwise the PPR entered will be given a status of POG).

The Interlocking will be configured to prevent the 'timing off' of route locking if there is a train in the route. This ensures that an opposing route cannot be set.

Figure 19:
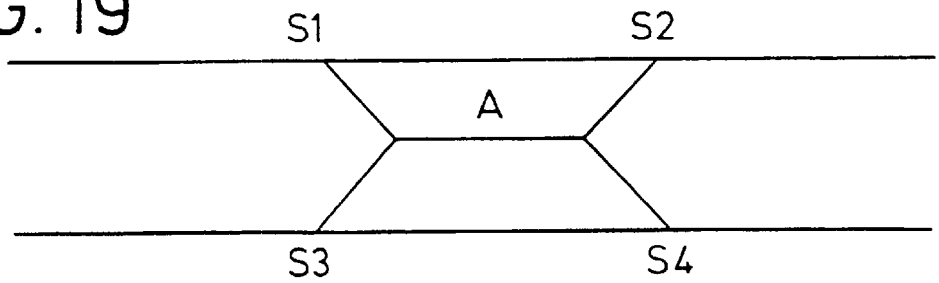

Consider the turn around sidings illustrated in FIG. 19.

An un-registered train enters the centre siding A from point S1. If the route into A can be timed off it would be possible for a registered train to enter A from S2 or S3 into a PPR that had not been given a status of POG.

The start of the replacement zone for a signal must be less than the minimum carriage length beyond the signal aspect that it replaces.

This is to ensure that another train cannot be hidden between the signal and the replacement zone when a registered train arrives at the signal and proves clear ahead.

All Traffic Locking Areas are protected by signals at their boundaries.

The Interlocking will only show proceed aspects at signals which authorise movement in the Traffic Locked Direction, all opposing signals will show a red aspect.

When a registered train joins/couples with a failed train that it is to be pulled out of service, the registered train must become de-registered. It is envisaged that this will be triggered by losing its knowledge of completeness. This ensures that the MBP does not provide a registered train with an LMA up to another registered train, through the train being pulled out.

No special processing is required for cross-overs or sidings.

Permission to enter a PPR will depend on the aspect of the signal protecting it, the status of that PPR and the type of train entering the PPR.

An unequipped train enters a PPR under the permission of a signal. Such a train is 'invisible' to the MBP so registered trains will only be allowed past the signal to follow an unequipped train if the signal displays a green aspect, thus proving that the unequipped train has exited the PPR.

A registered train of known completeness enters a PPR under the permission of a signal and the MBP. The MBP allows registered trains of known completeness past the signal if the signal displays a green aspect or a white aspect provided the PPR status is POW.

As a train passes a signal it enters the replacement zone of the signal. If a signal protects a PPR the interlocking will be configured to provide the MBP with a 'train entered route' input when the replacement zone becomes occupied and a route into a PPR is set. On receiving 'train entered route' the MBP will identify the associated PPR and check the locations of all registered trains under its control in order that the status of the PPR may be updated as follows:

If a registered train of unknown completeness has entered the PPR, the PPR status will be set to POG as the rear location of the train cannot be guaranteed.

If the MBP knows that a registered train of known completeness is entering the route then the relevant PPR will be given POW status.

If the MBP is not aware of any registered train entering the route the PPR entered will be given POG status, If the Interlocking reports 'train entered route' with no route set (implying that a train could have entered a PPR by proceeding past a red signal) then the action taken will be, either:

If the conditions above require a PPR to be given a status of POG, all PPRs associated with the signal will be given POG status.

If the conditions above require a PPR to be given a status of POW, do nothing.

FIG. 20 gives a pictorial representation of the states that the PPR may have and the transitions which can change these states.

Additional protection is provided by the MBP, for trains of unknown completeness. The MBP will mark the rear of the train of unknown completeness with an 'O' mark to signify the fact.

The MBP currently generates LMAs up to the rear of a registered train. If the LMA search were to encounter an 'O' mark (which should not happen because the route entered will have been given a status of POG) the LMA will be cancelled and the train become not proved clear ahead.

A registered train will be considered to be entering a PPR if any part of the area allocated to that train (from the rear of the train to the front of the LMA) coincides with the replacement zone of a signal when 'train entered route' is received from the interlocking.

FIG. 21 illustrates the situation when a train actually occupies the signal's replacement zone but its reported location is skewed before the replacement zone (train 1), within the replacement zone (train 2 and 3) and beyond the replacement zone (train 4).

| Reported location of train: | PPR status updated to: |
|---|---|
| 1 (train has exceeded its LMA) | POG |
| 2 | POW |
| 3 | POW |
| 4 (skewed ahead of Interlocking) | POG |

On initialisation all PPRs will be given a status of POG.

On initialisation no trains will be registered. A train must locate itself before it can attempt to register. Once a train has registered it must run in restricted manual to the next signal in order to prove clear ahead. Trains that are proved clear ahead are issued limit of movement authorities.

Before a registered train can have a limit of movement authority issued by an MBP, the MBP must prove that there is no un-registered train directly in front of the registered train. That is an un-registered train is not so close to the registered train that the interlocking is unable to distinguish between the registered train and the un-registered train in front of it. This process is known as "proving clear ahead".

A train will become proved clear ahead when it is within the minimum carriage length of a replacement zone for a facing signal which is displaying a proceed aspect. If the registered train is within a minimum carriage length of the replacement zone and the signal shows a proceed aspect there cannot be anything directly in front of the registered train.

In order to grant movement permission beyond a signal the MBP is provided with signal aspect information from the interlocking. The MBP limits a train's LMA according to the signal's aspect as follows:

Red—LMA limited to the location of the signal.

Green—LMA allowed to go beyond the signal.

White—The PPR associated with the route set is identified. If the PPR status is

POW—LMA to the location of the signal.

POW—LMA allowed to go beyond the signal.

If both a main-line signal and a shunt signal are located at the same position then the MBP will interpret the combined aspects as follows:

| Shunt | Main | MBP Interpretation |
|---|---|---|
| Horizontal (Red) | Red | Red |
| 45 degrees (Green) | Red | Green |
| Horizontal (Red) | White | White |
| Horizontal (Red) | Green | Green |

All other combinations are invalid and interpreted as red.

It is possible for a signal to display both a Red/White and Green aspect if the route is set and locked (but the train's stop arm has not lowered). The MBP will use a valid single aspect (red, white or green) and interpret any other combination as red.

The following mechanism protects against an unregistered train that has tripped and proceeded and entered a replacement zone along with a registered train.

When a train enters a replacement zone, as indicated by the 'train entered route' input from the interlocking, the MBP processes PPR status as normal and starts an 'entered route' timer. If the train exits the replacement zone the 'train entered route' input disappears and the timer is aborted. If the timer expires the PPR is given a status of POG.

Note: This assumes that a train must wait 60 seconds before proceeding beyond a red signal. Where there are no train stops trains may not be tripped and may rely on procedures to ensure that the 60 seconds is adhered to.

When a train passes over a set of points there may be an intermittent loss of points detection. The unsettling of points by the passage of a train must be filtered out otherwise the MBP will shorten the LMA of a train crossing points.

The MBP will constrain an LMA to the location of a set of undetected points only if the undetected points are not within the current LMA. Hence an LMA will not be shortened if points subsequently go undetected underneath a train.

Note the LMA is generated from the rear of the train forwards in order to limit the trains movement permission if a constraint e.g. an ESA becomes active underneath the train.

Traffic Locking is the prevention of changes in the direction of traffic in a track section unless the change can be accomplished safely (having regard, for example, to the speeds and locations of trains in and around that track section). It may also prevent the establishment of any route which is in conflict with the established direction of traffic.

To facilitate traffic locking, the MBP will be configured with Traffic Locking Areas. A Traffic Locking Area (TLA) is protected by the interlocking via signals at its boundary, it is defined as a set of segments and may not overlap with other TLAs in the same direction. A TLA is defined as 'active' while neither direction is set during a change of traffic direction.

When the direction of travel within a TLA is to be changed:

the MBP is informed that the TLA is active by the interlocking, all trains within the TLA are set to not proved clear ahead, all trains approaching the TLA are limited by a signal showing a red aspect at the entry to the TLA, all the PPR's wholly or partly contained within the TLA are given a status of POG.

This means that there need be no relationship between the disjoint sets of PPRs that are contained in a TLA.

After a traffic switching period of 60 seconds to guarantee all trains in the TLA become stationary, the interlocking will set routes in the new TLA direction and will inform the MBP that the TLA is no longer active.

The trains within the TLA must prove clear ahead before they can be given an LMA. Since proving clear ahead can only be performed at a signal showing a proceed aspect, and only those signals which protect trains travelling in the traffic locked direction show a proceed aspect, the MBP does not need to know the traffic locked direction.

Consider two traffic locking areas defined for eastbound (segments A, B and C) and westbound (segments D, E and F) traffic, as illustrated in FIG. 22.

Figure 23:
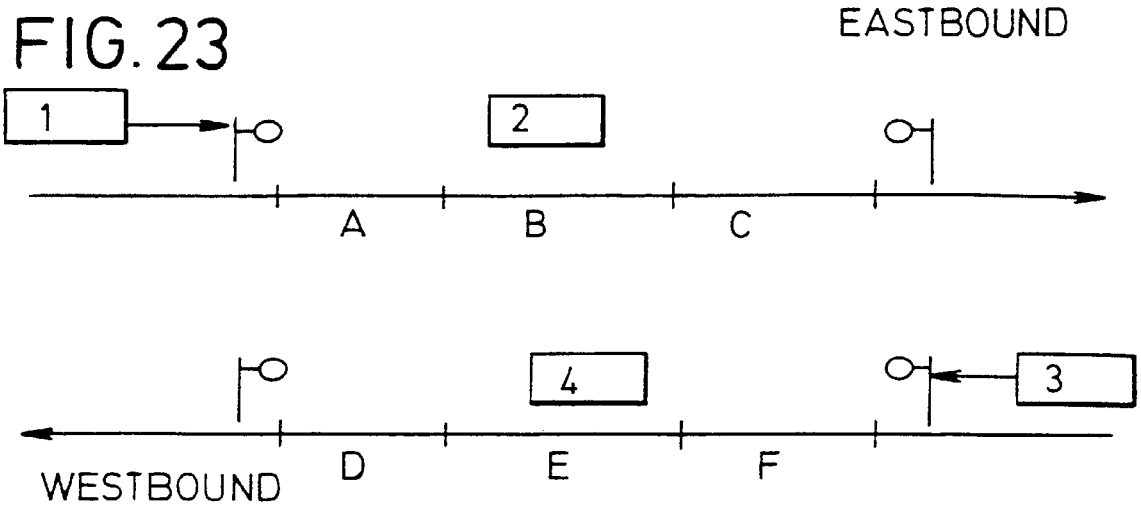

When a TLA is activated the MBP will stop all trains within the activated TLA. In FIG. 23:

Trains 2 and 4 are stopped when both TLAs are activated.

Trains 1 and 3 prevented from entry to each TLA.

The interlocking provides the following information to control traffic locking areas.

Traffic Locking Areas identifier.

Activation status (active, inactive).

Note that the activation of TLAs is similar to the mechanism employed to activate ESAs.

When a train de-registers the rear extremity of the area that the train was last given permission to move within is marked, and the PPRs within or containing the area that the train was last given permission to move within, are given a status of POG. This ensures that the MBP can protect the de-registered train from registered trains, provided it does not perform an invalid move.

The mark used to identify the rear of the area within which the de-registered train should lie is termed 'U' mark.

A 'U' mark is removed when either:

it is passed by a registered train, or the aspect for the signal protecting the route containing the 'U' mark becomes green (the route is guaranteed clear).

The implication for the inter-MBP protocol is that the confirmed distribution of 'U' marks and their associated PPRs is required to ensure that all the relevant PPRs are given a status of POG.

Note the set of associated PPRs are those PPRs within or containing the area allocated to the de-registered train and may be under the control of adjacent MBPs.

The area of interest of an MBP must extend to the entry signal to enable the 'U' mark to be cleared.

Figure 24:
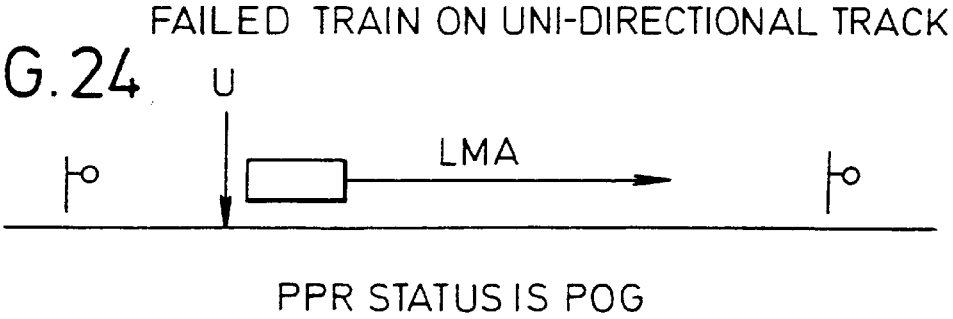

FIG. 24 provides a simple example of when a train de-registers. It shows the use of a 'U' mark to identify the rear extremity of the area that the de-registered train has permission to be within, and that the state of the PPR is set to POG.

Figure 25:
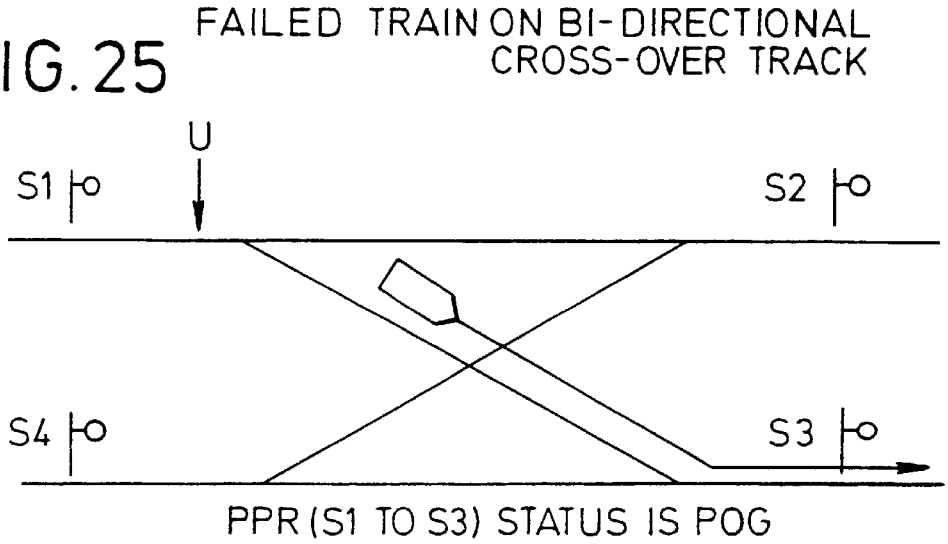

FIG. 25 shows a more complicated de-registration scenario. The rear 'U' mark is in rear of the points, but the train has cleared the route release point before stopping. The 'U' mark is dropped to protect trains beyond signal S1 within the route S1 to S3, in other words behind the de-registered train.

In the example a route can thus be set from S1 to S2 which will clear the 'U' mark because S1 will show a green aspect for the PPR containing the 'U' mark. If the route S1 to S3 is then set the de-registered train will be protected by the aspect of signal S1 and the status of the PPR from S1 to S3.

The routes from S2 to S4 from S3 to S1 and from S3 to S4 are protected by the interlocking while the route S1 to S3 is wholly or partially set.

'U' marks have a direction which points to the obstruction they are protecting. A 'U' mark is not an obstruction during an LMA search if the direction of the 'U' mark is opposite to the direction of the search.

When an MBP fails, the registered trains under its control will no longer be visible to the other MBPs. In order to protect the registered trains in this instance the MBP adjacent to the failed MBP will perform the following actions, set all PPRs that enter the failed MBP's area of control to POG, limit LMAs of trains to the boundary of the area of control of the failed MBP.

Figure 26:
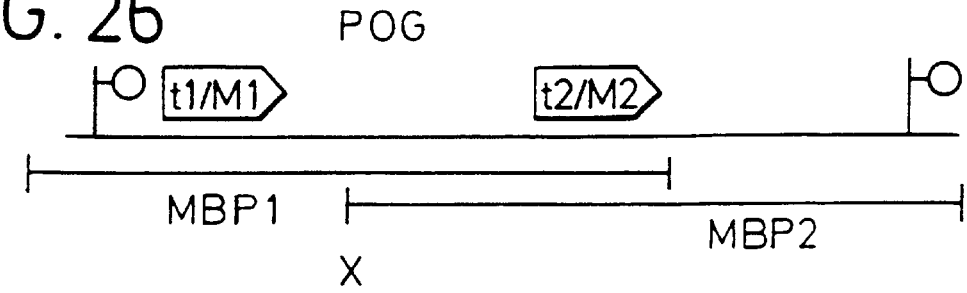

In the example illustrated in FIG. 26, if MBP2 train t2 becomes invisible to MBP1. MBP1 on detecting the failure of MBP2 will limit the LMA of t1 to the boundary of MBP2's area of control (X) and change the status of the PPR to POG.

When an MBP is initialised at start up or after repair it is possible that a registered train that has had its LMA limited to the boundary of the area of control of the newly initialised MBP may have its LMA extended into the area of control of the newly initialised MBP. However, it is possible that an un-registered train lies within the area of control of the newly initialised MBP and is visible to the MBP that has extended the LMA.

To prevent this an MBP places a mark on the boundary of its area of control when the MBP becomes initialised. This mark is termed an 'I' mark.

Figure 27:
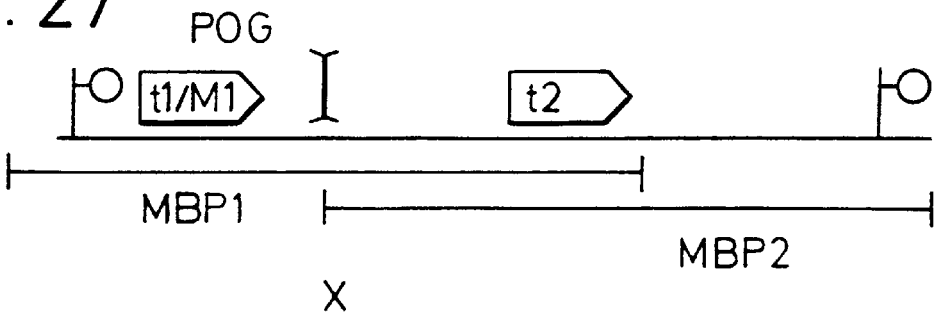

FIG. 27 demonstrates the placement of the 'I' mark. Train t1 is under the control of MBP1, while MBP2 is not active its LMA is limited to the boundary of the area of control of MBP2—location X in the diagram. Once MBP2 is initialised MBP1 will attempt to provide t1 with an LMA into the area of control of MBP2. However, if t2 is not registered it will be invisible to MBP1 and so t1 may be given an LMA through it. The use of the 'I' mark prevents t1's LMA being extended through t2.

'I' marks are removed when either:

a registered train passes the 'I' mark, or the signal protecting the PPR shows a green aspect (this implies that the area of interest of an MBP must extend to the entry signal of the PPR to enable the 'I' mark to be cleared).

Figure 28:
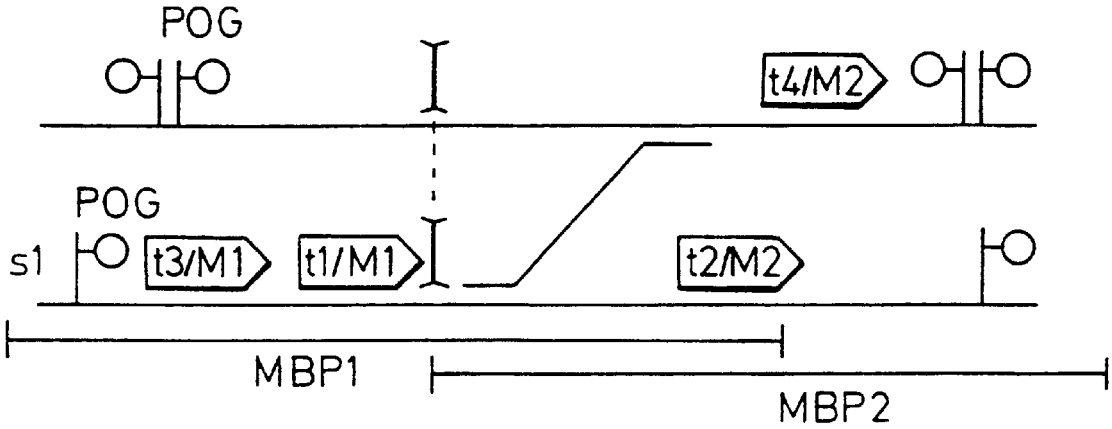

Consider the more complicated scenario of a divergence occurring in the vicinity of an MBP boundary, as shown in FIG. 28. In this example there are two trains between signal S1 and the points it protects. Train t1 will pass over the 'I' mark removing it, t3 is still protected as the points are still route locked and thus t3 will follow t1. The points lie cannot be changed until the route between the signal S1 and the set of points is un-occupied. When the route changes the signal aspect and the status of the PPR from the signal provide the protection.

PPR configuration for more complex scenarios will now be described.

Figure 29:
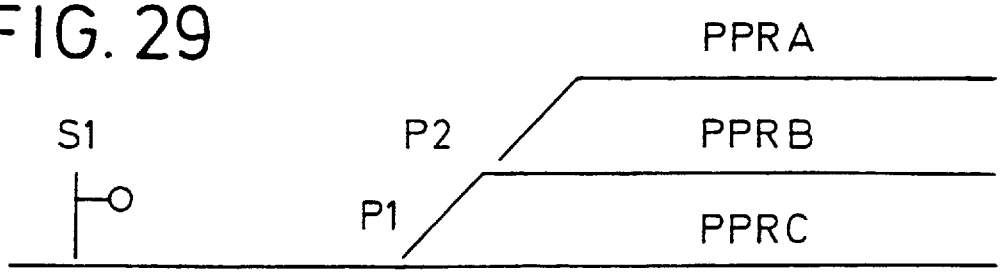

A route may consist of multiple sets of points. The MBP allocates status for each PPR that may be entered via a white aspect. Consider the example shown in FIG. 29.

Each PPR status is independent of each other. A train may be over a set of points or in part of the route set which is common to other routes but the route cannot be changed until the train has cleared the sectional route release protected by the signal. However this rule does not hold if one of the points (say P2) within the PPR to be taken by the train becomes undetected, the interlocking indicates a null route set when the train enters the route. In this case as the route to be followed by the train is not set and locked it is possible that the train could take any route, thus all PPRs leading from the signal S1 will be given a status of POG.

Figure 30:
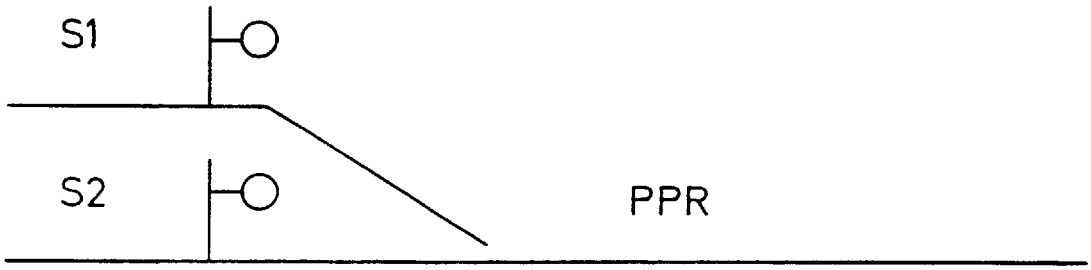

The PPR status for a convergence is common to both entry signals. Hence a single PPR status is affected by entry to either route beyond signal S1 or S2 in FIG. 30.

Figure 31:
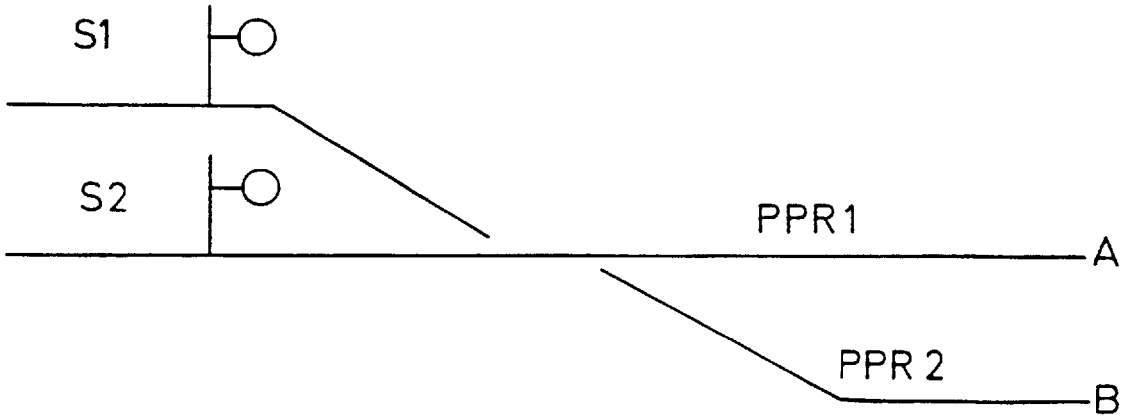

In the example shown in FIG. 31 the divergence is so close to the convergence that the same signals control both the convergence and the divergence. This network can be considered as two PPRs (PPR1 and PPR2) each of which can be entered from either signal (S1 or S2).

PPR1 can be triggered by:

a train passing S1 with a route set to A.

a train passing S2 with a route set to A.

PPR2 can be triggered by:

a train passing S1 with a route set to B.

a train passing S2 with a route set to B.

The interlocking prevents a train from passing one of the signals en route for A and then being routed to B (thus potentially invalidating the PPR status of PPR2). Similarly, trains that are en route for B cannot be routed to A once past a signal.

We claim:

1. A vehicle control system for issuing control signals to vehicles to control their movements along a route between a first location and a second location, the vehicles comprising a set of vehicles of a first type, to which the system can issue control signals at more than one location within the route to control the vehicles of the first type in a moving block manner and a set of vehicles of a second type to which the system cannot issue control signals at more than one location within the route, the system comprising:

sensing means which senses vehicles entering and leaving the route, and the type of these vehicles;

storage means which stores a record of the number of vehicles within the route and a record of the type of vehicle that most recently entered the route;

signalling means for signalling to vehicles whether they may enter the route by moving beyond the first location; and control means which receives information form the storage means and transmits signals to the signalling means, and which:

1) in response to the storage means indicating that there is at least one vehicle within the route and that the vehicle that most recently entered the route was of the first type controls the signalling means to issue a signal of a first type indicating that only vehicles of the first type may enter the route;

2) in response to the storage means indicating that there are no vehicles within the route controls the signalling means to issue a signal of a second type indicating that vehicles of the first type or the second type may enter the route; and 3) otherwise controls the signalling means to issue a signal of a third type indicating that no vehicles may enter the route.

2. A vehicle control system according to claim 1, which allows the direction of travel of vehicles along the route to be reversed from a first direction toward the second location to a second direction towards the first location, wherein:

the signalling means signals to vehicles to indicate the movements the vehicles are permitted to make;

the sensing means senses the presence and/or location of vehicles, there being processing means for processing information received form the sensing means to determine the safety of movement of vehicles; and the control means controls the signalling means in response to a command to reverse the direction of travel of vehicles along the route from the first direction to the second direction by:

1) controlling the signalling means to signal any vehicle switching the route to halt;

2) controlling the signalling means to signal any vehicles approaching the route not to enter the route in the first direction by passing beyond the second location or in the second direction by passing beyond the first location;

3) waiting for a period sufficient to allow any vehicles within the route to reach a halt; and 4) if the processing means determines it is safe, controlling the signalling means to signal any vehicles within the route to move in the second direction and/or controlling the signalling means to permit a vehicle to enter the route in the second direction.

3. A vehicle control system according to claim 1, for controlling a vehicle's doors at a stopping location, the system comprising:

communication means comprising a receiver located on the vehicle and a transponder located at the stopping location, the communication means being such that the receiver can only communicate with the transponder when the vehicle is at a predetermined stopping position;

sensing means for sensing that the vehicle is stopped; and door control means for receiving information from the communication means and the sensing means and permitting the vehicle's doors to open when the vehicle is sensed to be stopped and there is communication between the receiver and the transponder.

4. A vehicle control system as claimed in claim 3, wherein stopping position is determined such that with the vehicle in the stopping position the positions of the vehicle's doors correspond to the positions of doors at the stopping location.

5. A vehicle control system according to claim 1, comprising:

a tachometer on a vehicle for detecting the rate of rotation of the vehicle's wheels;

doppler speed measuring apparatus for detecting the vehicle's speed;

communication means comprising a receiver borne by the vehicle for periodically communicating with transponders at fixed locations; and processing means for correlating information from the tachometer, the doppler speed measuring apparatus and the communication means to estimate the vehicle's speed and location.

* * * * *